US009815309B2

(12) United States Patent
Van Coppenolle et al.

(10) Patent No.: US 9,815,309 B2
(45) **Date of Patent: *Nov. 14, 2017**

(54) CASSETTE FOR LABEL PRINTER

(71) Applicant: DYMO, Sint-Niklaas (BE)

(72) Inventors: Frank Van Coppenolle, Sint-Lievens-Houtem (BE); Jimmy Dullaert, Stekene (BE); Kris Vandermeulen, Bornem (BE)

(73) Assignee: DYMO, Sint-Niklaas (BE)

( * ) Notice: Subject to any disclaimer, the term of this patent is extended or adjusted under 35 U.S.C. 154(b) by 0 days.

This patent is subject to a terminal disclaimer.

(21) Appl. No.: 15/140,942

(22) Filed: Apr. 28, 2016

(65) Prior Publication Data

US 2016/0250873 A1 Sep. 1, 2016

Related U.S. Application Data

(63) Continuation of application No. 14/448,386, filed on Jul. 31, 2014, now Pat. No. 9,346,297, which is a continuation of application No. 12/990,365, filed as application No. PCT/EP2009/055228 on Apr. 29, 2009, now Pat. No. 8,834,047.

(30) Foreign Application Priority Data

Apr. 29, 2008 (GB) ..... 0807800.8

(51) Int. Cl.
*B41J 15/04* (2006.01)
*B41J 32/00* (2006.01)
*B41J 3/407* (2006.01)

(52) U.S. Cl.
CPC ..... *B41J 32/00* (2013.01); *B41J 3/4075* (2013.01); *B41J 15/044* (2013.01)

(58) Field of Classification Search
None
See application file for complete search history.

(56) References Cited

U.S. PATENT DOCUMENTS 4,511,903 A 4/1985 Miyazaki et al.
4,729,676 A 3/1988 Smith et al.
(Continued)

FOREIGN PATENT DOCUMENTS

CN 1085497 A 4/1994
CN 1291956 A 4/2001
(Continued)

OTHER PUBLICATIONS

International Search Report and Written Opinion from PCT/EP2009/055228, dated Aug. 8, 2009.
(Continued)

*Primary Examiner* — Jill Culler
(74) *Attorney, Agent, or Firm* — Marshall, Gerstein & Borun LLP

(57) ABSTRACT

A label printing apparatus, comprising a cassette-receiving bay adapted to receive a cassette, said cassette-receiving bay having a base, an opening opposite the base, and side walls extending between the base and the opening; a cassette locking mechanism comprising at least one locking element having a locking position for engagement with a cassette inserted into said cassette-receiving bay; and cassette detection means operable to determine whether said at least one locking element is engaged with a cassette inserted into the cassette-receiving bay.

19 Claims, 28 Drawing Sheets

(56) References Cited

U.S. PATENT DOCUMENTS

| | | | |
|---|---|---|---|
| 4,815,871 | A | 3/1989 | McGourty et al. |
| 4,974,977 | A | 12/1990 | Morgan et al. |
| 5,017,942 | A | 5/1991 | Asakura et al. |
| 5,078,523 | A | 1/1992 | McGourty et al. |
| 5,088,845 | A | 2/1992 | Kurachi |
| 5,141,342 | A | 8/1992 | Kawahara |
| 5,211,491 | A | 5/1993 | Harvey |
| 5,374,132 | A | 12/1994 | Kimura |
| 5,411,339 | A | 5/1995 | Bahrabadi et al. |
| 5,437,511 | A | 8/1995 | Halket et al. |
| 5,597,247 | A | 1/1997 | Inakoshi et al. |
| 5,918,989 | A | 7/1999 | Stout, Jr. et al. |
| 6,017,159 | A | 1/2000 | Tse |
| 6,604,874 | B2 | 8/2003 | Carriere et al. |
| 6,644,876 | B2 | 11/2003 | Carriere et al. |
| 6,830,391 | B2 | 12/2004 | Clayvon et al. |
| 8,834,047 | B2 | 9/2014 | Van Coppenolle et al. |
| 2002/0012558 | A1 | 1/2002 | Huss et al. |
| 2004/0179212 | A1 | 9/2004 | Kurashina |
| 2005/0281600 | A1 | 12/2005 | Akaiwa et al. |
| 2006/0088802 | A1 | 4/2006 | Akaiwa |
| 2008/0085142 | A1 | 4/2008 | Caveney et al. |
| 2008/0286026 | A1 | 11/2008 | Kubota et al. |
| 2012/0170959 | A1 | 7/2012 | Vandermeulen et al. |
| 2014/0340463 | A1 | 11/2014 | Van Coppenolle et al. |

FOREIGN PATENT DOCUMENTS

| | | | |
|---|---|---|---|
| CN | 1376115 | A | 10/2002 |
| CN | 1517223 | A | 8/2004 |
| CN | 1709702 | A | 12/2005 |
| CN | 1762720 | A | 4/2006 |
| CN | 101022956 | A | 8/2007 |
| CN | 101039807 | A | 9/2007 |
| CN | 101060985 | A | 10/2007 |
| DE | 4218924 | C1 | 12/1993 |
| EP | 1 308 299 | A1 | 5/2003 |
| EP | 1 738 914 | A2 | 1/2007 |
| JP | 56013193 | A | 2/1981 |
| JP | 6026862 | | 2/1985 |
| JP | 63207673 | A | 8/1988 |
| JP | 01047579 | A | 2/1989 |
| JP | 64047579 | | 2/1989 |
| JP | S6447579 | A | 2/1989 |
| JP | 02072991 | A | 3/1990 |
| JP | 08058203 | | 3/1996 |
| JP | 10100503 | A | 4/1998 |
| JP | 11066246 | | 3/1999 |
| JP | 3333324 | B2 | 10/2002 |
| WO | WO-2006/013466 | A2 | 2/2006 |
| WO | WO-2006/024913 | A2 | 3/2006 |
| WO | WO-2008/122630 | A1 | 10/2008 |

OTHER PUBLICATIONS

Combined Search and Examination Report from UK Application GB0807800.8, dated Jul. 30, 2009.

Further Search Report from UK Application No. GB0807800.8, dated Mar. 25, 2010.

Second Office Action for Chinese Application No. 200980124442.4, dated Jul. 24, 2012.

Extended Search Report for European Application No. 12194458.1, dated Feb. 19, 2013.

English Translation of First Office Action for Japanese Patent Application No. 2011-506714.

Extended European Search Report for EP Application No. 14162795.0, dated Jun. 3, 2014.

Notification of the First Office Action for Chinese Application No. 201310139036.3, dated Aug. 5, 2014, with an English translation.

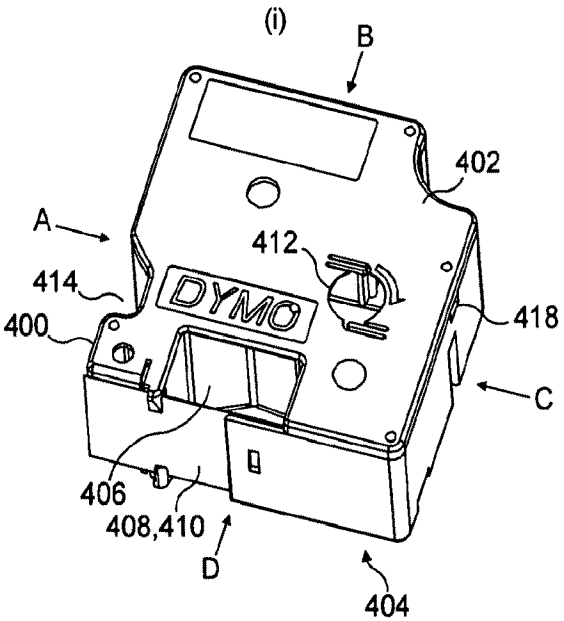
FIG. 18a
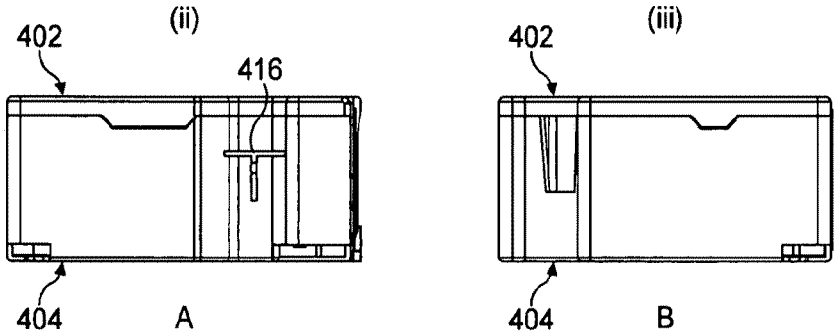
FIG. 18b
FIG. 18c
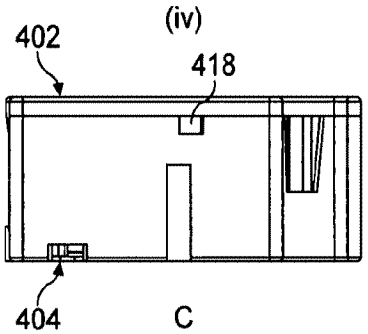
FIG. 18d

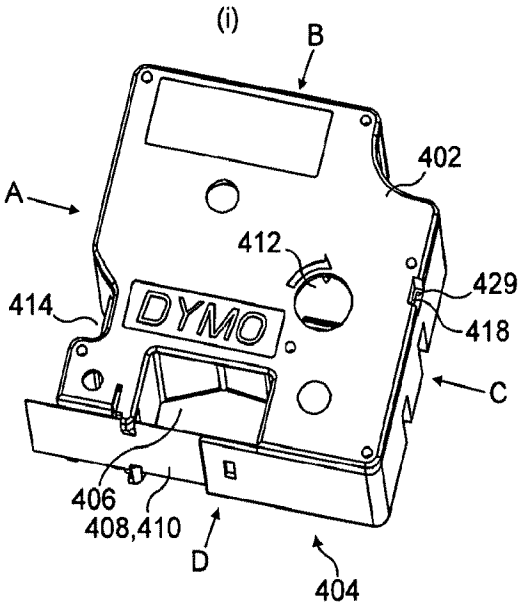
FIG. 19a
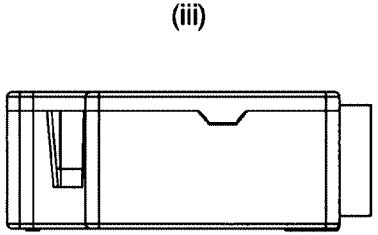
FIG. 19c
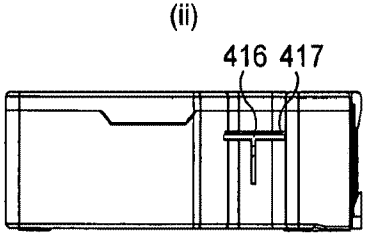
FIG. 19d
FIG. 19b (i)

(ii)

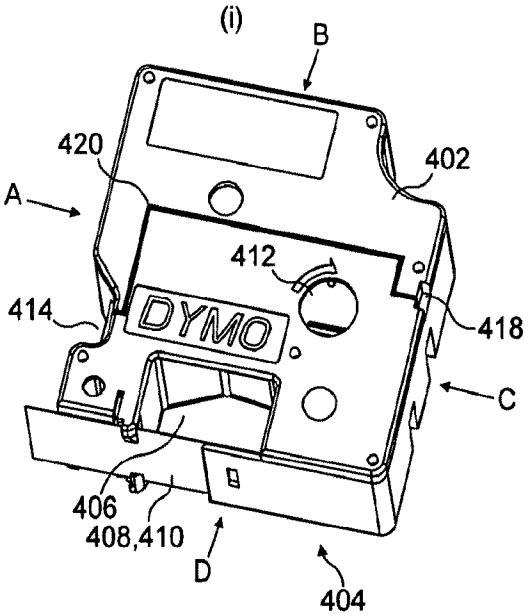
FIG. 24a
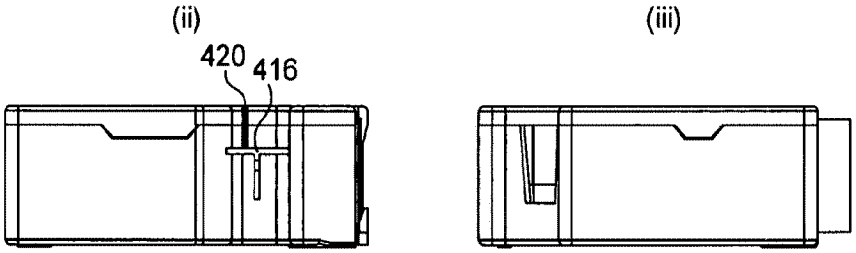
FIG. 24b
FIG. 24c
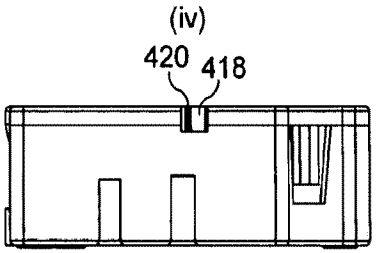
FIG. 24d

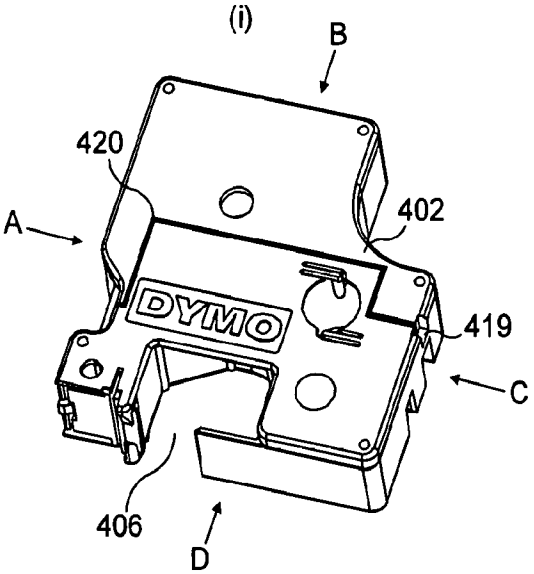
FIG. 25a
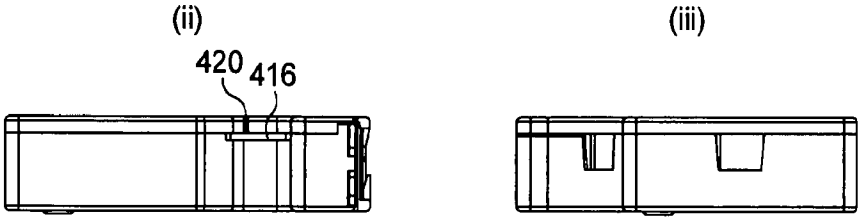
FIG. 25b
FIG. 25c
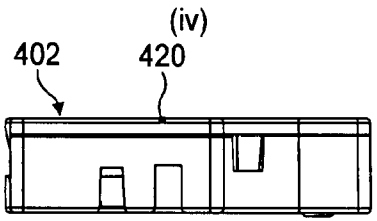
FIG. 25d

CASSETTE FOR LABEL PRINTER

CROSS-REFERENCE TO RELATED APPLICATIONS

This is a continuation of U.S. application Ser. No. 14/448,386, filed Jul. 31, 2014, which is a continuation of U.S. application Ser. No. 12,990,365, filed Dec. 20, 2010, which is the US national phase of PCT/EP2009/055228, filed Apr. 29, 2009, based on GB 0807800.8, filed Apr. 29, 2008, the entire respective disclosures of which are hereby incorporated by reference.

FIELD OF THE INVENTION

The present invention relates to a label printer, and particularly to a label printer with cassette detection means and to a cassette for use in a label printer.

BACKGROUND OF THE INVENTION

Label printers are known, which use a supply of tape, housed in a cassette, received in the label printer. The tape comprises an image receiving layer and a backing layer which are secured to one another via an adhesive layer. Such label printers include a cutting mechanism for cutting off a portion of the tape after an image has been printed onto the image-receiving layer so that the portion of tape having the image can be used as a label. After the tape has been cut, the cut portion of the tape is pulled from the printer through a slit in the printer housing. The backing layer can then be removed allowing the image-receiving layer to be secured to an object using the adhesive layer.

Known label printers comprise a cassette-receiving bay in which a cassette is received for printing. A printhead is provided in the cassette-receiving bay for co-operating with the supply of tape to print thereon. A platen may also be provided in the cassette-receiving bay positioned at a side of the tape opposite to the printhead when the cassette is received in the cassette-receiving bay. During printing, the printhead co-operates with the platen, with the tape passing therebetween for printing thereon. The platen may be driven by a motor for propagating the tape during printing. Alternatively, the platen may be freely rotatable and an additional drive roller may be provided for driving the tape during printing.

In an alternative arrangement to that described above, a platen may be provided within the cassette. In such an arrangement, the tape cooperates with a surface of the platen. When received in the cassette-receiving bay the platen in the cassette co-operates with a drive mechanism in the cassette-receiving bay for driving the tape during printing. Alternatively, the platen is freely rotatable and an additional drive roller may be provided for driving the tape. During printing, the printhead in the cassette-receiving bay co-operates with the platen in the cassette with tape passing therebetween for printing thereon.

In one arrangement, the printhead is moveable between a non-printing position and a printing position. In an alternative arrangement, the platen is moveable between a non-printing position and a printing position. In yet another arrangement, both the platen and printhead are movable so as to have non-printing and printing positions.

The tape may be of a direct thermal type on which printing is achieved by direct application of heat from printing elements on the printhead. Alternatively, an ink ribbon may be provided, whereby ink is transferred from the ribbon to an image receiving tape by application of heat to the ink ribbon via printing elements on the printhead. The cassette may include a roll of die cut labels rather than a continuous tape.

A problem exists in all the above-described arrangements, in that for good quality printing the tape and/or ink ribbon must be correctly aligned with the printhead during printing. Furthermore, the tape must remain correctly aligned with the printhead while printing occurs and must smoothly pass the printhead so as to ensure good quality printing. In order to ensure that this is the case, it is advantageous to prevent the cassette from moving during printing and cutting. Furthermore, the position of the cassette within the cassette-receiving bay should be predefined and readily reproducible whenever a cassette is inserted in the cassette-receiving bay.

The problem is exacerbated in hand held printers which may be moved around during printing. In such an apparatus, it is even more important that the cassette is locked in a fixed position during printing.

WO 2006/013466 (DYMO) discloses a cassette locking and ejecting arrangement for a label printer apparatus. A label printer comprising a cassette-receiving bay in which a tape cassette is inserted, is provided. The cassette receiving bay is provided with a plurality of spring-loaded ejecting members for ejecting a cassette from the cassette-receiving bay. When a cassette is inserted in the cassette receiving bay, a pair of locking members hold the cassette in place against the biasing force exerted by the ejecting members. To eject the cassette, the locking members are disengaged from the cassette allowing the cassette to be pushed out of the cassette-receiving bay by the force exerted by the ejecting members.

There is a problem with the above-described arrangement, that when a cassette is inserted into the cassette receiving bay by a user, it is possible that the cassette will not properly engage with all of the locking members. This may occur, for example, if a user presses on only one edge of the cassette during insertion. If a cassette is engaged with one, but not all, of the locking members, then although the cassette may be retained within the cassette receiving bay against the biasing force of the ejecting members, the cassette may not be aligned properly with respect to the platen and print head for printing.

WO 2006/013466 (DYMO) has a pair of locking members which are biased, by means of a spring, towards a locking position so as to lock a cassette inserted into the cassette receiving bay in place. However, in the event that the label printer apparatus is subjected to a sudden impact, i.e. if it is dropped by a user, it is possible that the locking members will be moved against the biasing force of the spring so as to release the cassette. Accordingly, when a user subsequently resumes printing with the label printer apparatus, the cassette will not be properly locked in the cassette receiving bay in the correct position for printing, and printing will be adversely effected or impossible.

Furthermore, in the case that a cassette inserted into a cassette receiving bay is not properly engaged by one or more of a plurality of locking members, it may not be apparent to a user, which locking members are not engaged properly with the cassette and what action is required in order to rectify the problem.

SUMMARY OF THE INVENTION

It is an aim of the present invention to solve at least some of the problems described above.

According to a first aspect of the present invention, there is provided a label printing apparatus, comprising a cassette-receiving bay adapted to receive a cassette, said cassette-receiving bay having a base, an opening opposite the base, and side walls extending between the base and the opening; a cassette locking mechanism comprising at least one locking element having a locking position for engagement with a cassette inserted into said cassette-receiving bay; and cassette detection means operable to determine whether said at least one locking element is engaged with a cassette inserted into the cassette-receiving bay.

According to a second aspect of the present invention, there is provided a cassette comprising at least one locking portion for engaging with a cooperating locking element of a tape printer when said cassette is correctly inserted in said printer, said locking portion comprising a conductive area.

According to a third aspect of the present invention, there is provided a cassette comprising a housing and a conductive connection, said conductive connection making a connection between a first area and a second area on said housing.

A fourth aspect of the present invention provides a combination of a label printing apparatus according to the first aspect and a cassette according to the second or third aspect.

BRIEF DESCRIPTION OF THE DRAWINGS

For a better understanding of the present invention and to show how the same may be carried into effect, embodiments of the present invention will now be described by way of example only with reference to the accompanying drawings, in which:

FIG. 18*a* is a top perspective view of a 24 mm cassette for use with the cassette detection means of FIG. 17;

FIG. 18*b* is a right side view, taken in the direction designated by the arrow A of FIG. 18*a*, of the 24 mm cassette illustrated in FIG. 18*a;*

FIG. 18*c* is a rear view, taken in the direction designated by the arrow B of FIG. 18*a*, of the 24 mm cassette illustrated in FIG. 18*a;*

FIG. 18*d* is a left side view, taken in the direction designated by the arrow C of FIG. 18*a*, of the 24 mm cassette illustrated in FIG. 18*a;*

FIG. 19*a* is a top perspective view of a 19 mm cassette for use with the cassette detection means of FIG. 17;

FIG. 19*b* is a right side view, taken in the direction designated by the arrow A of FIG. 19*a*, of the 19 mm cassette illustrated in FIG. 19*a;*

FIG. 19*c* is a rear view, taken in the direction designated by the arrow B of FIG. 19*a*, of the 19 mm cassette illustrated in FIG. 19*a;*

FIG. 19*d* is a left side view, taken in the direction designated by the arrow C of FIG. 19*a*, of the 19 mm cassette illustrated in FIG. 19*a;*

FIG. 24*a* is a top perspective view of a 19 mm cassette for use with the cassette detection means of FIG. 22;

FIG. 24*b* is a right side view, taken in the direction designated by the arrow A of FIG. 24*a*, of the 19 mm cassette illustrated in FIG. 24*a;*

FIG. 24*c* is a rear view, taken in the direction designated by the arrow B of FIG. 24*a*, of the 19 mm cassette illustrated in FIG. 24*a;*

FIG. 24*d* is a left side view, taken in the direction designated by the arrow C of FIG. 24*a*, of the 19 mm cassette illustrated in FIG. 24*a;*

FIG. 25*a* is a top perspective view of a 12 mm cassette for use with the cassette detection means of FIG. 22;

FIG. 25*b* is a right side view, taken in the direction designated by the arrow A of FIG. 25*a*, of the 12 mm cassette illustrated in FIG. 25*a;*

FIG. 25*c* is a rear view, taken in the direction designated by the arrow B of FIG. 25*a*, of the 12 mm cassette illustrated in FIG. 25*a;*

FIG. 25*d* is a left side view, taken in the direction designated by the arrow C of FIG. 25*a*, of the 12 mm cassette illustrated in FIG. 25*a;*

DETAILED DESCRIPTION OF PREFERRED EMBODIMENTS OF THE INVENTION

Figure 1:
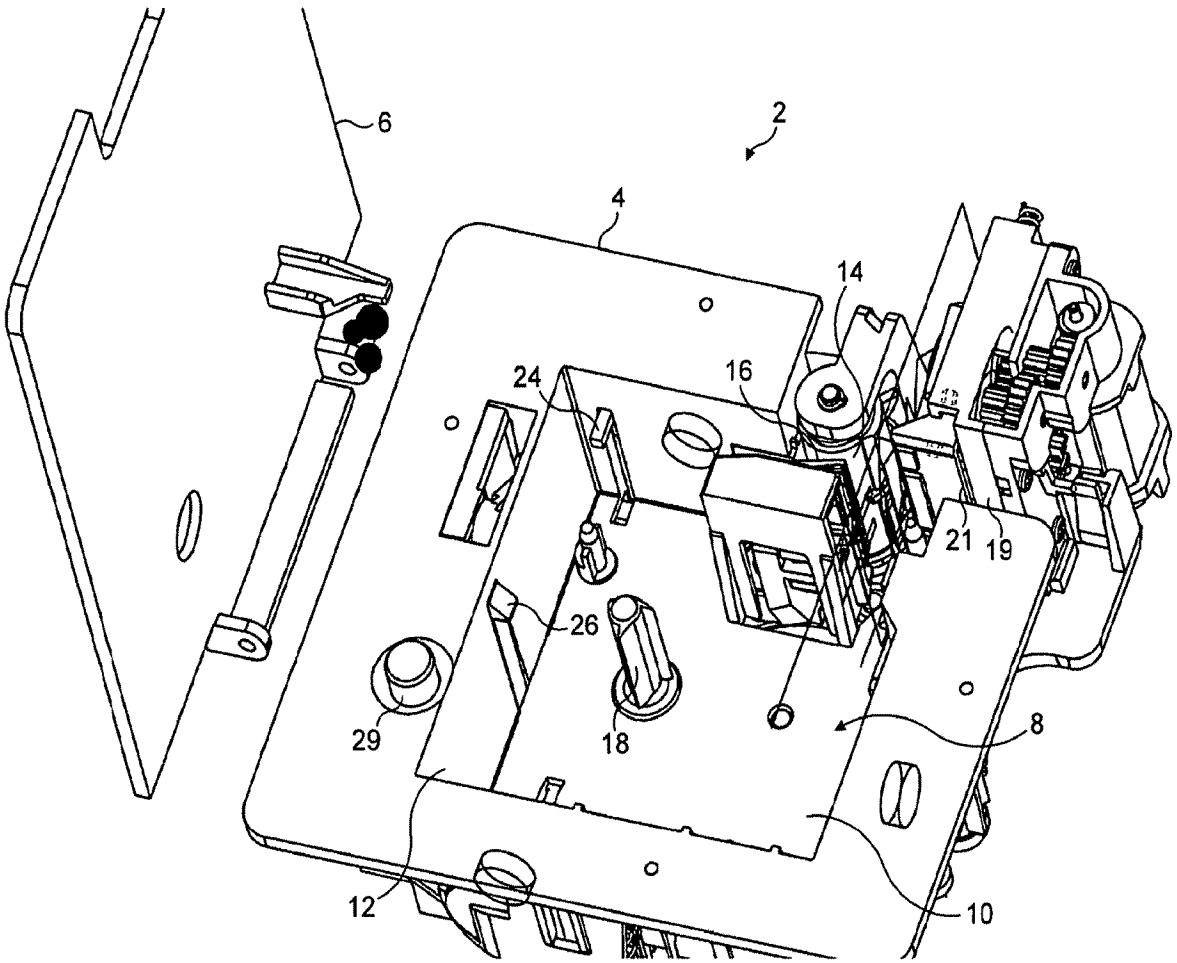
FIG. 1 is a top perspective view of an embodiment of a label printer according to the present invention, the label printer having its lid open and no cassette present.

Referring to FIG. 1, the label printer 2 comprises a body 4, a lid (or cover) 6 and a cassette-receiving bay 8. The cassette-receiving bay 8 has an opening in a top portion of the body for vertical insertion of a cassette. The lid 6 is hinged for closing over the top opening. In an alternative embodiment, the lid (or cover), may be a detachable lid which is completely detachable from the body 4 of the label printer 2 when in an open position.

The cassette-receiving bay 8 comprises a recess forming an opening for receiving a cassette. The recess is formed by a base 10 and sides 12 extending from the base 10 to the top opening. A platen 14 and a printhead 16 are provided in the cassette-receiving bay 8. The printhead 16 is movable towards the platen 14 whereby, during printing, the printhead 16 co-operates with the platen 14, with tape passing therebetween for printing thereon. The platen 16 is driven by a motor (not shown) for propagating the tape during printing. An ink ribbon take-up sprocket 18 extends from the base 10 of the cassette-receiving bay 8 for cooperating with an ink ribbon take-up spool of a cassette when inserted into the cassette-receiving bay 8. The sprocket 18 is driven by a motor (not shown) for winding the ink ribbon around the ink ribbon take-up spool during printing. A slit 19 is provided in the body 4 of the label printer forming an exit through which the tape passes after printing. A cutting mechanism 21 is provided adjacent the exit slit 19 for cutting off the printed portion of tape to provide a printed label.

A first ejector element 24 is visible on a side-wall of the cassette-receiving bay 8. Also visible in FIG. 1 is a locking element 26 of a locking mechanism (which is not visible) on the left hand side of the cassette-receiving bay 8. An actuator button 29 is provided on the surface of the body 4 for actuating the locking mechanism.

Figure 2:
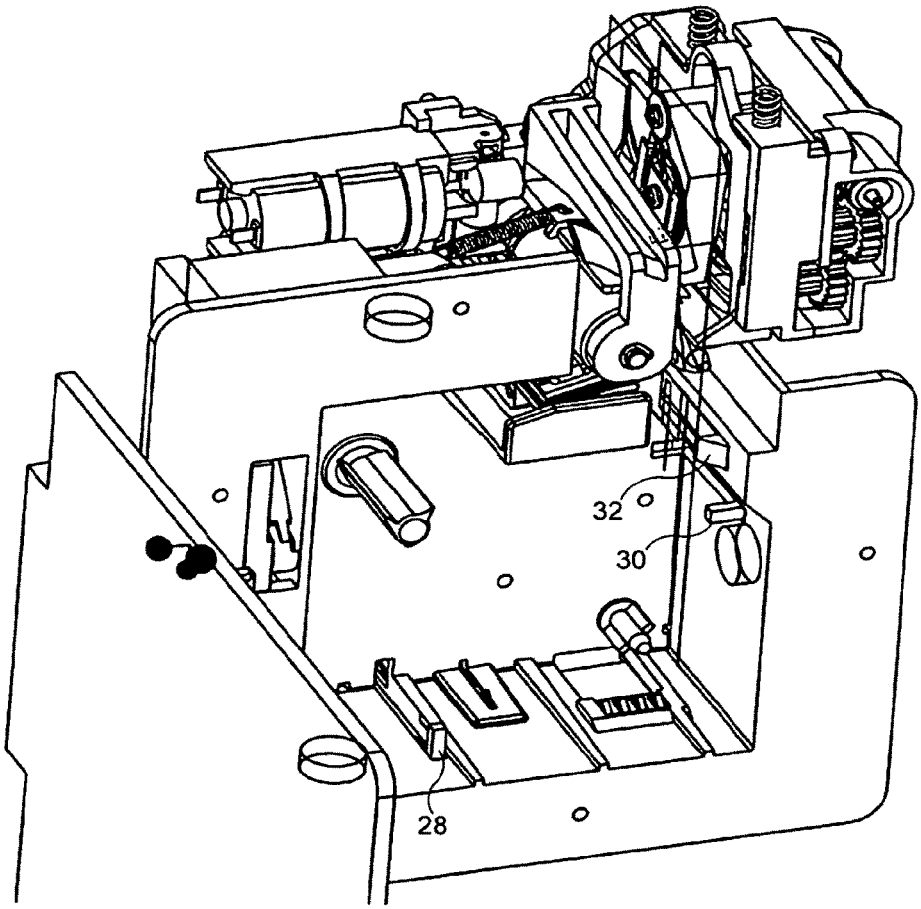
FIG. 2 is another top perspective view of the label printer shown in FIG. 1.
Figure 3:
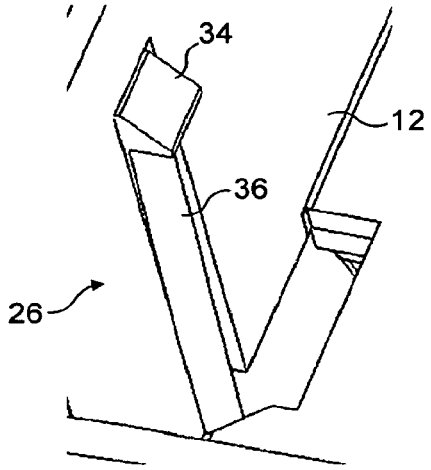
FIG. 3 is a view illustrating the position of a first locking element of the label printer shown in FIG. 1.
Figure 4:
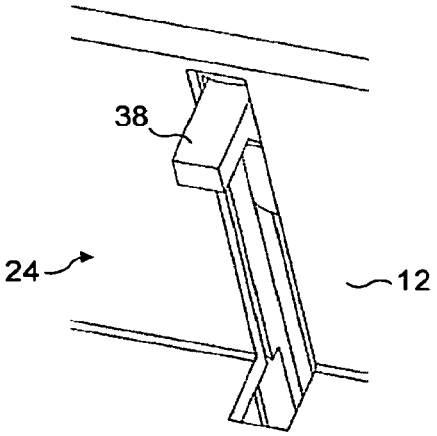
FIG. 4 is a view illustrating the position of a first ejector element of the label printer shown in FIG. 1
Figure 5:
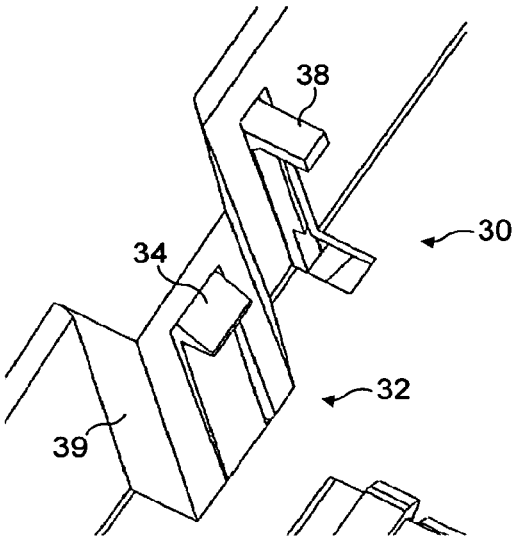
FIG. 5 is a view illustrating the position of a second locking element of the label printer of FIG. 2.
Figure 6:
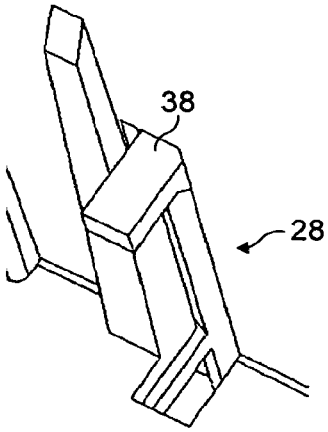
FIG. 6 is a view illustrating the position of a second ejector element of the label printer shown in FIG. 2.

Referring to FIG. 2, a second ejector element 28 of a second ejector mechanism (which is not visible) is shown on the opposite side wall of the cassette receiving bay 8 to the first ejector element 24. A third ejector element 30 of a third ejector mechanism (which is not visible) is positioned on the right hand side of the cassette receiving bay 8. A second locking element 32 of the locking mechanism (which is not visible) is positioned on the right hand side of the cassette-receiving bay 8.

Referring to FIGS. 3, 4, 5 and 6, each of the locking and ejector elements 24, 26, 28, 30, 32 are provided at the sides of the cassette-receiving bay 8 and extend into the cassette-receiving bay 8 through openings in the sides for interaction with an inserted cassette.

Each locking element 26, 32 comprises a projection 34 and an elongate element 36 extending in a direction from the base 10 to the top opening of the cassette-receiving bay 8. The projection 34 is at a top end of the elongate element 36 and extends towards a central portion of the cassette-receiving bay 8 through a corresponding opening in the side wall 12 of the cassette-receiving bay 8. Each projection 34 has a sloped upper surface for cooperating with a cassette inserted into the cassette-receiving bay 8 for moving the locking element from a locking position to an unlocked position. One of the side walls of the cassette-receiving bay 8 has a portion 39 projecting into the cassette-receiving bay 8 forming a guide for a corresponding recess in a cassette when inserted into the cassette-receiving bay 8. The locking element 32 is positioned in an opening in the guide 39 and extends therefrom into the cassette-receiving bay 8 thereby forming a combined guiding and locking arrangement.

Each ejecting element 24, 28, 30 extends from the side wall of the cassette-receiving bay 8 part way into the cassette-receiving bay 8 and has a free end unconnected to any other structural elements. The ejector elements 24, 28, 30 comprise an elongate element 38 extending in a perpendicular direction relative to the side wall through an opening in the side wall.

Figure 7:
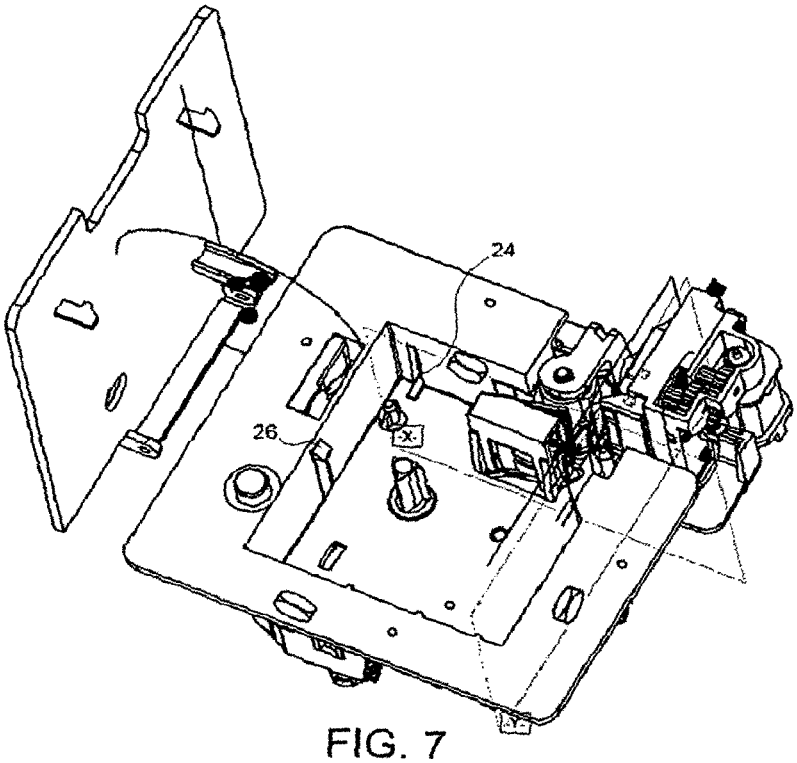
FIG. 7 is a top perspective view of the label printer of FIG. 1 illustrating the positions of a first locking element and a first ejector element with a cassette installed in the cassette-receiving bay (the cassette is not shown for clarity)
Figure 8:
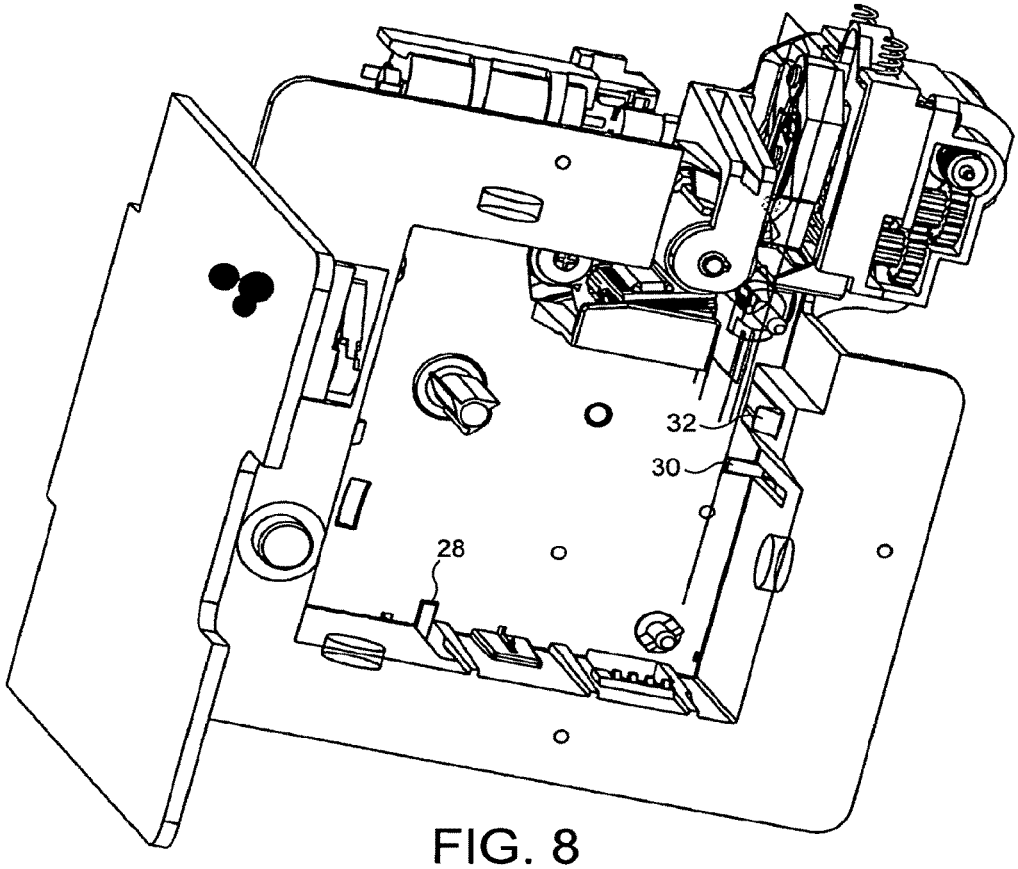
FIG. 8 is another top perspective view of the label printer shown in FIG. 7.
Figure 9:
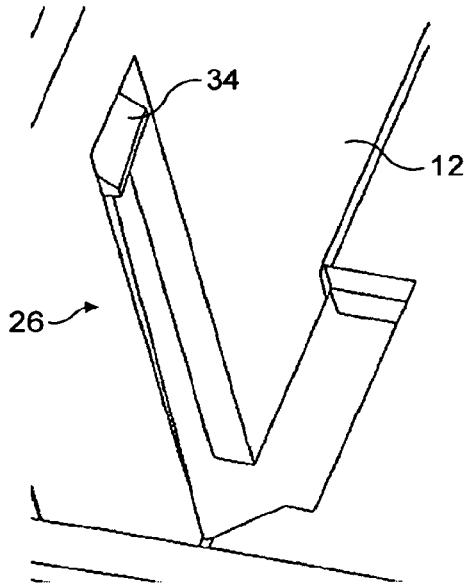
FIG. 9 is a view illustrating the position of the first locking element shown in FIG. 3 during insertion/ejection of a cassette.
Figure 10:
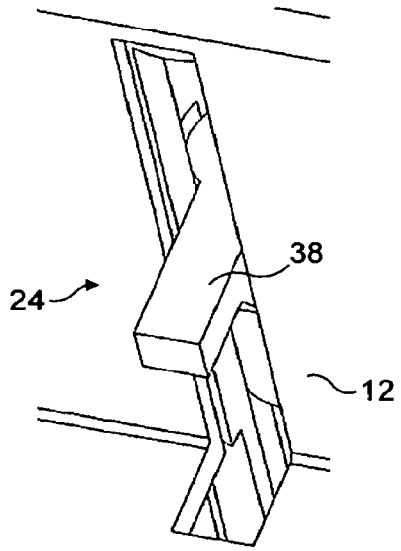
FIG. 10 is a view illustrating the position of the first ejector element shown FIG. 4 during insertion/ejection of a cassette.
Figure 11:
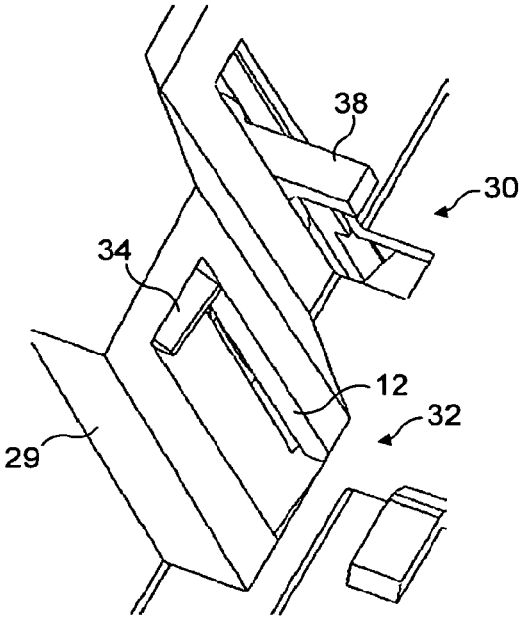
FIG. 11 is a view illustrating the positions of the second locking element and the second ejector element shown in FIG. 5 during insertion/ejection of a cassette.
Figure 12:
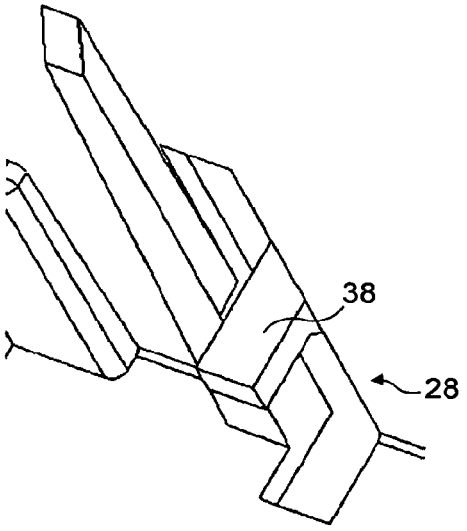
FIG. 12 is a view illustrating the position of the third ejector element shown in FIG. 6 during insertion/ejection of a cassette.

Referring to FIGS. 7 and 8, when a cassette is installed in the cassette-receiving bay 8, the first, second and third ejector elements 24, 28, 30 are pushed down to the base 10 and the first and second locking elements 26, 32 are in the locking position.

FIGS. 9, 10, 11 and 12 illustrate the positions of the locking and ejector elements 24, 26, 28, 30, 32 when the cassette is being inserted into the cassette-receiving bay 8. In FIGS. 9, 10, 11 and 12 the cassette is not shown for clarity.

During insertion, the cassette contacts the locking and ejector elements 24, 26, 28, 30, 32. The projections 34 of the locking elements 26, 32 have sloped upper surfaces such that as the cassette is inserted the locking elements 26, 32 are pushed backwards by the cassette into corresponding openings in the side walls 12. The locking elements 26, 32 are in their unlocked position. The locking elements 26, 32 are spring loaded to move into the locking position when the cassette is fully loaded as shown in FIGS. 7 and 8. The locking elements 26, 32 prevent the cassette from moving in an upward direction by interacting with locking features in the cassette. The ejectors 24, 28, 30 are spring loaded and cooperate with an underside of the cassette.

To eject a cassette, the ejector button 29 is actuated by a user pressing down on it, which, unlocks the mechanism by moving the locking elements 26, 32 backwards into their corresponding openings in the side walls 12 of the cassette-receiving bay 8. The cassette is thus released and the ejectors 24, 28, 30 push the cassette upwards for easy removal from the printer 2.

Figure 13:
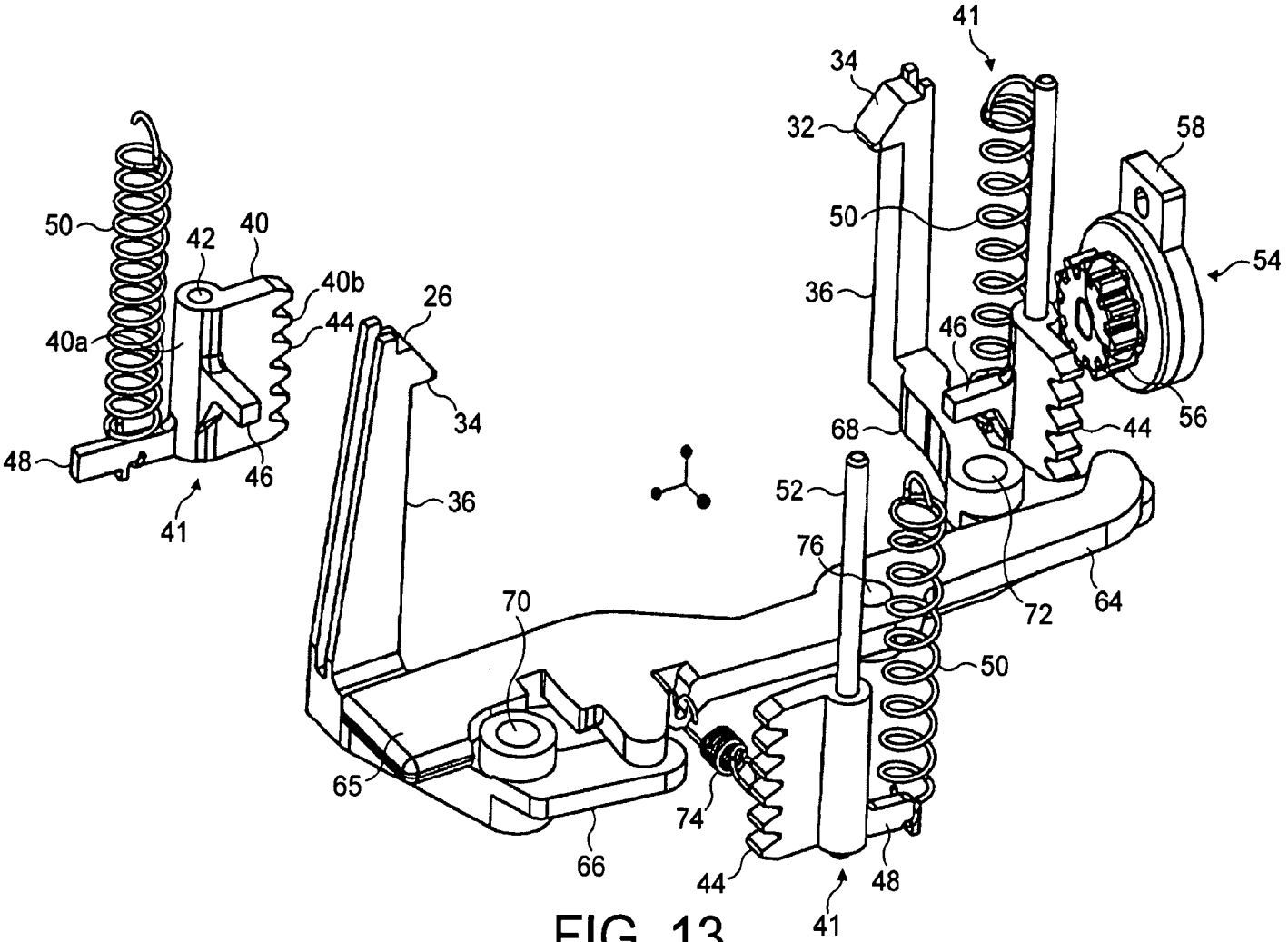
FIG. 13 is a view of the ejector mechanisms and the locking mechanism of the label printer of FIG. 1.

Referring to FIG. 13, the locking mechanism and the ejector mechanisms will now be described in more detail. The ejectors 41 each comprise a body portion 40. Adjacent to a first edge 40*a* thereof, the body portion 40 has hole 42 formed therethrough, the axis of the hole arranged so as to be parallel to the first edge 40*a* of the body portion 40. The hole 42 has a circular cross-section. Along a second edge 40*b* of the body portion 40, opposite the first edge 40*a*, the body portion 40 comprises a rack portion 44. An ejector element 46 extends perpendicularly from the plane of the body portion 40, which extends between the first and second edges 40*a*, 40*b*, from a point adjacent to the first edge 40*a* of the body portion 40, i.e. adjacent to the hole 42. The ejector element 46 is arranged so as to extend through a slit (not shown) in the side wall 12 of the cassette-receiving bay 8. Each ejector 41 further comprises a biasing member 48 at the bottom end of the first edge 40*a* of the body portion 40. The biasing member 48 extends in the plane of the body portion 40 perpendicular to the axis of the hole 42. The biasing member 48 is coupled to one end of an expansion spring 50, for biasing the ejector element 46 towards the top end of the corresponding slit (not shown) in the side wall 12 of the cassette-receiving bay 8. The top end of the slit in the side wall 12 is the end adjacent to the top opening of the cassette receiving bay 8, with the bottom end of the slit being that which is adjacent to the base 10 of the cassette receiving bay 8.

The body portion 40 of the ejector mechanism 41 is mounted on a shaft 52, which extends through the hole 42 in the body portion 40. A damper 54 is disposed adjacent to the rack portion 44 of the body portion 40. The damper 54 comprises a pinion (or gear) 56 which is rotatably mounted to a damper mount part 58.

Figure 14:
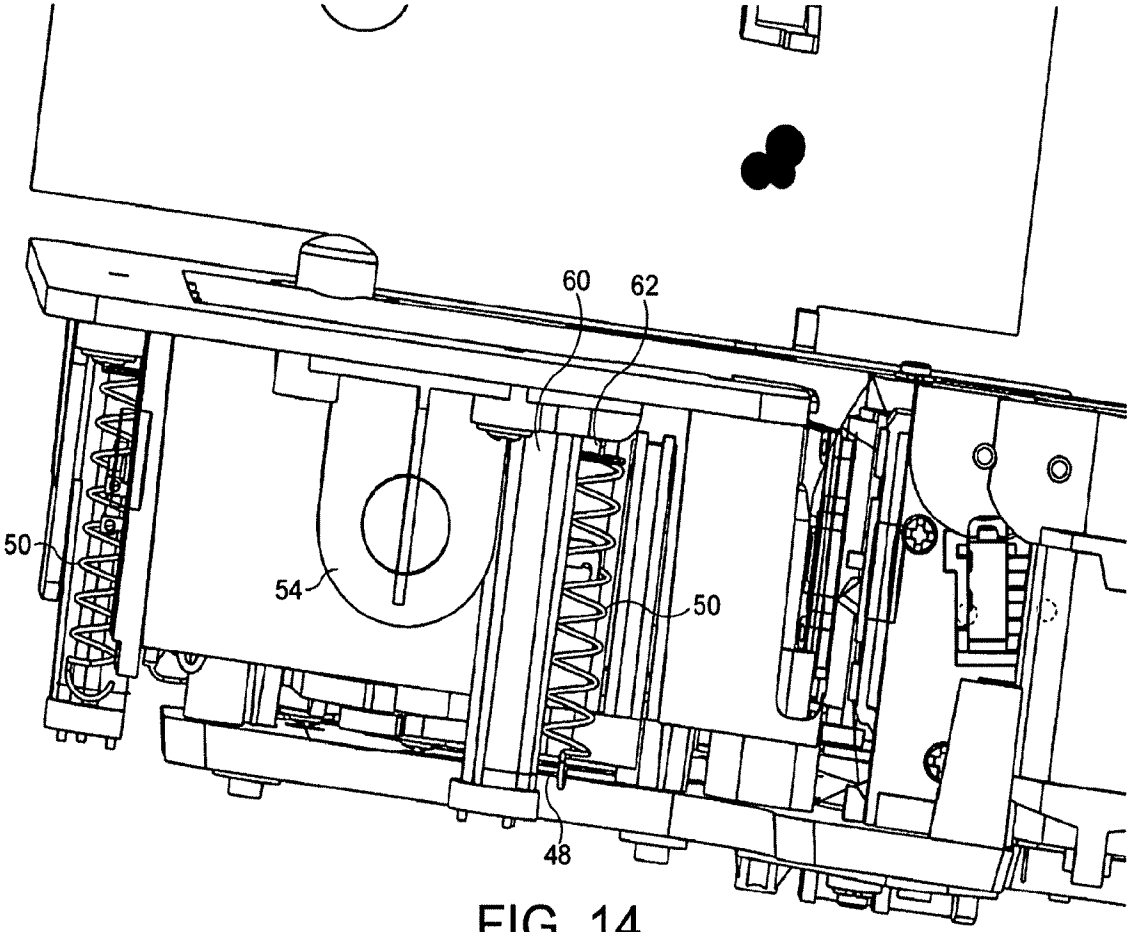
FIG. 14 is a side perspective view of the right hand side of the label printer of FIG. 1, showing an ejector mechanism.

FIG. 14 shows an ejector mechanism 41 of the label printer 2. As can be seen from FIG. 14, the ejector mechanism 41 comprises an ejector housing 60. The ejector housing 60 is approximately cylindrical in shape. The shaft 52 of the ejector mechanism 41 is disposed so as to be co-axial with the ejector housing 60. Accordingly, the body portion 40 is slidably mounted within the ejector housing 60, by means of the shaft 52 passing through the hole 42 formed at the first end 40*a* of the body portion 40. The ejector housing 60 comprises a first elongate opening along its length (not shown). The first elongate opening of the ejector housing 60 is aligned with a corresponding slit formed in a side wall 12 of the cassette receiving bay 8. The ejector element 46 of the ejector mechanism 41 protrudes into the cassette-receiving bay 8 through the first elongate opening and through the slit in the side wall 12, so as to interact with a cassette. The ejector housing 60 further comprises a second elongate opening (not shown) through which the biasing member 48 of the body portion 40 extends. As can be seen in FIG. 14, the biasing member 48 is attached to the lower end of the spring 50, i.e. the end of the spring 50 closest to the base 10 of the cassette receiving bay 8. The ejector housing 60 comprises a fixed extension 62 disposed at an upper end of the housing 60, adjacent to the top of the second elongate opening. The upper end of the spring 50 is attached to the fixed extension 62. Accordingly the spring 50 acts so as to bias the body portion 40 of the ejector mechanism 41 towards the upper end of the housing 60. The ejector housing 60 further comprises a third elongate opening (not shown), through which the rack portion 44 at the second edge 40*b* of the body portion 40 extends. The third elongate opening is aligned relative to a damper 54, such that the rack portion 44 meshes with the pinion 56 of the damper 54.

Figure 15:
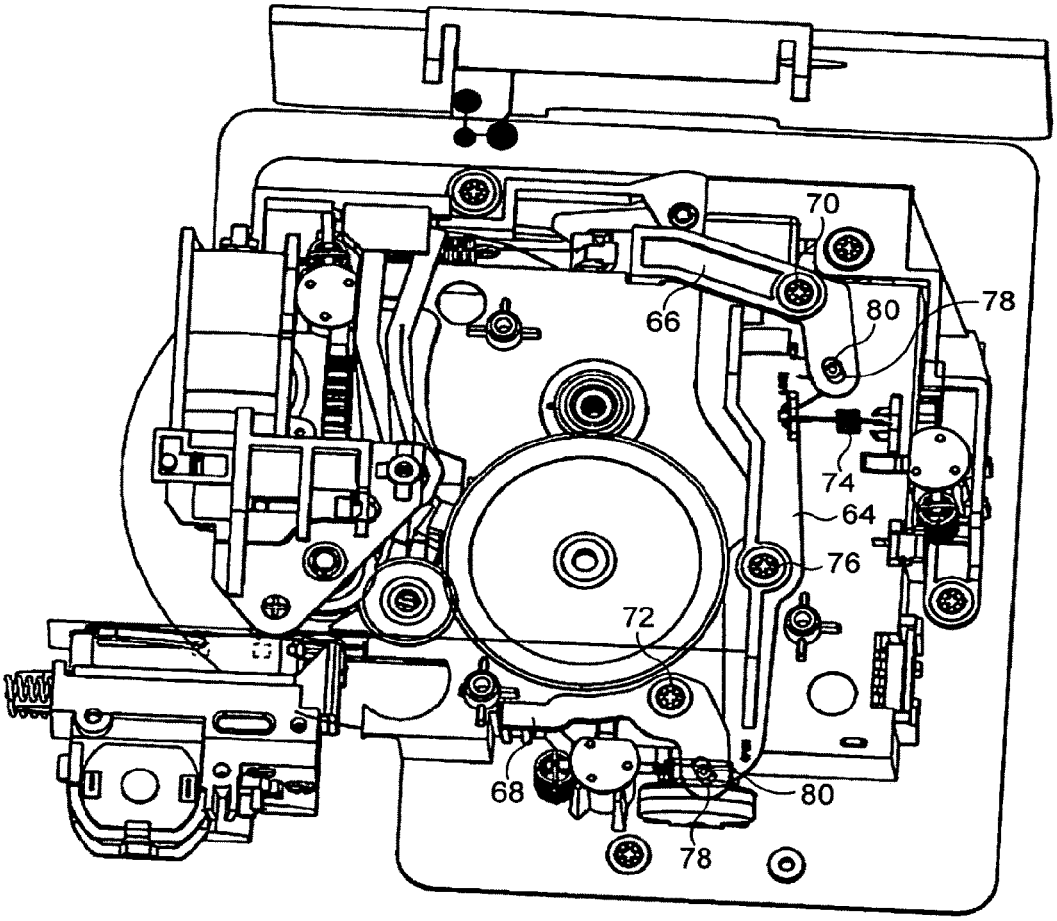
FIG. 15 is a bottom perspective view of the label printer of FIG. 1.

Referring to FIGS. 13 and 15, the locking mechanism will now be described in more detail. The locking mechanism comprises the two locking elements 26, 32. As described previously, the locking elements 26, 32 each comprise an elongate element 36 and a projection 34. Each projection 34 has a sloped upper surface for cooperating with a cassette inserted into the cassette-receiving bay 8 for moving the locking elements 26, 32 from the locking position to the unlocked position. The locking elements 26, 32 are coupled together by an actuating bar 64. Each of the locking elements 26, 32 is coupled to the actuating bar 64 by a respective coupling member 66, 68 extending in a perpendicular direction relative to the locking element. The locking elements 26, 32 have respective centres of rotation 70, 72 on opposite sides of the actuating bar 64 to each other. The centres of rotation 70, 72 comprise pivot points attached to the printer body 4. A return spring 74 is provided for biasing the locking elements 26, 32 towards the locking position. The actuating bar 64 has a centre of rotation 76, which also comprises a pivot point attached to the printer body 4. The first locking element 26 is rotatably coupled to the actuating bar 64 by means of a slot 78, provided in the distal end of the coupling member 66 relative to the first locking element 26, which cooperates with a pin 80 provided at a first end 65 of the actuating bar 64. The second locking element 32 is similarly rotatably coupled to a second end of the actuating bar 64.

Figure 16:
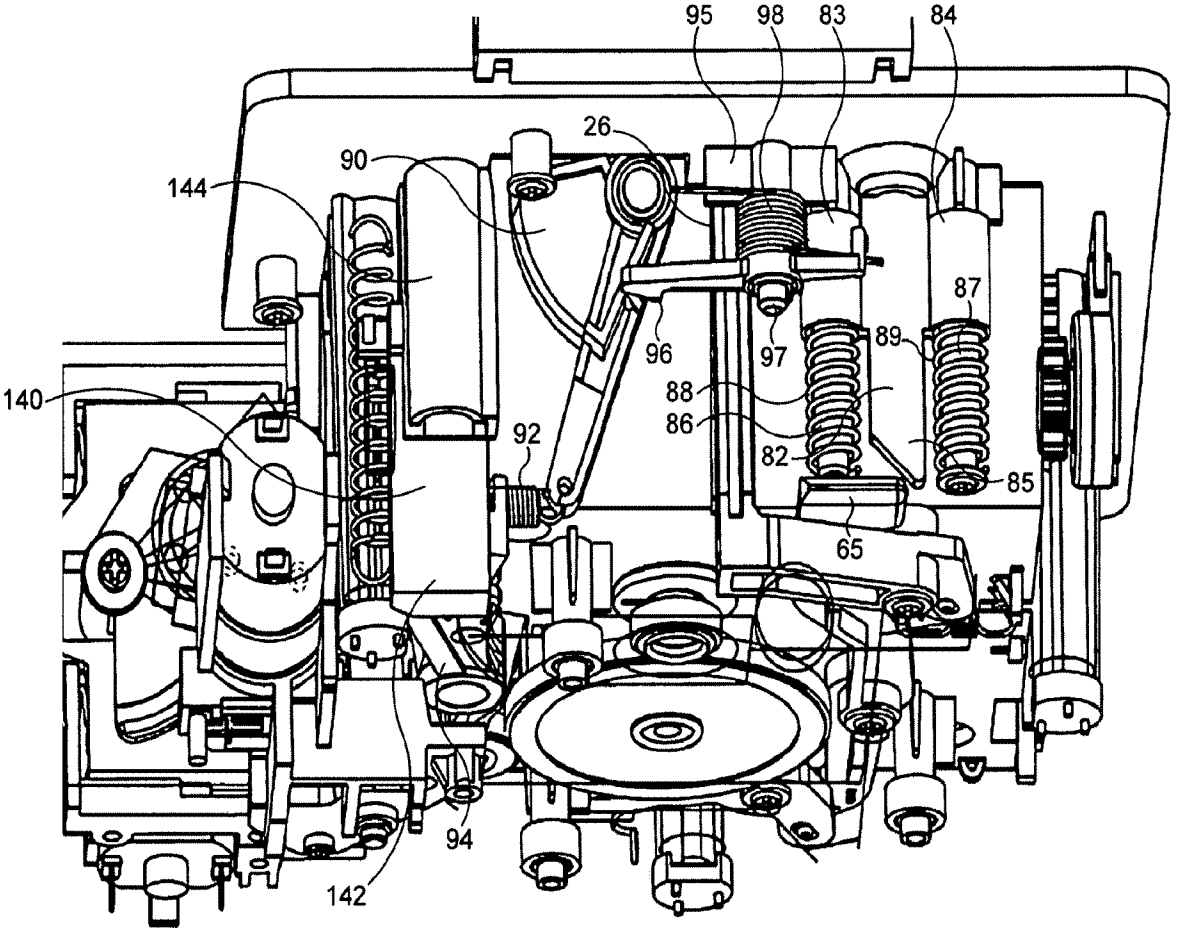
FIG. 16 is a side perspective view of the left hand side of the label printer of FIG. 1, showing a print head stop mechanism according to the present invention, when the lid of the label printer is open and no cassette is inserted.

Referring FIG. 16, the ejector button 29 is disposed adjacent to the cassette-receiving bay 8, so as to be pressed by a user to eject a cassette from the cassette-receiving bay 8 when the lid 6 is open and a cassette is inserted. The ejector button 29 comprises an actuator part 82. The upper end of the actuator part (not shown) has a circular cross-section and extends through an opening in the upper surface of the label printer 2, such that it can be pressed by a user. The lower end of the actuator part 82 comprises first and second tubular portions 83, 84 and a flange part 85 disposed therebetween. The flange part 85 of the ejector button actuator part is angled at the lower end thereof, at an angle of approximately 450. First and second button guide shafts 86, 87 are mounted to the printer body 4 and pass through the first and second tubular portions 83, 84 of the actuator part 82, respectively, so as to guide the motion of the actuator part 82 when pressed by a user. First and second eject button springs 88, 89 are disposed on the first and second guide shafts 86, 87, respectively, so as to bias the actuator part 82 towards the top of the label printer 2.

Figure 17:
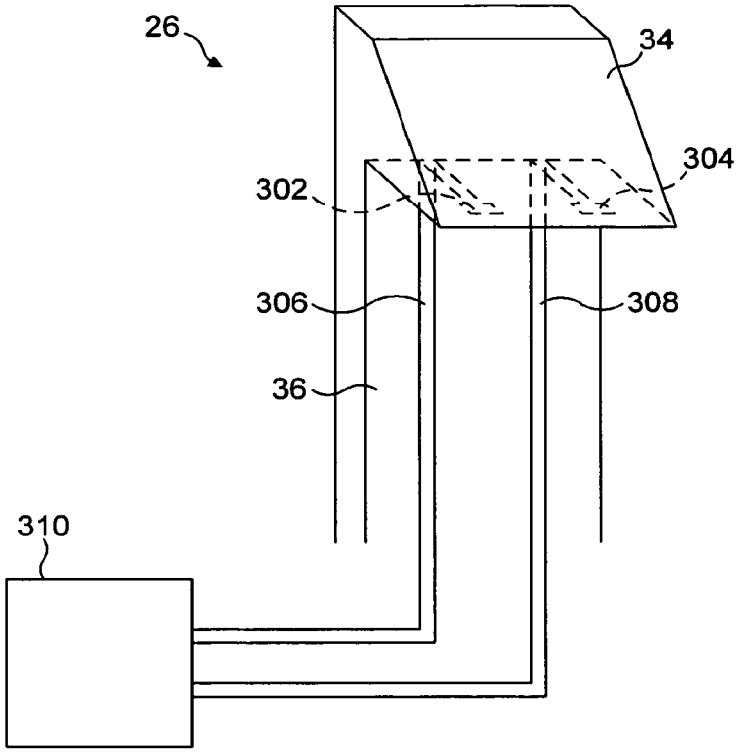
FIG. 17 is an enlarged view of the first locking element shown in FIG. 4, showing cassette detection means according to a first embodiment of the present invention.
Figure 20A:
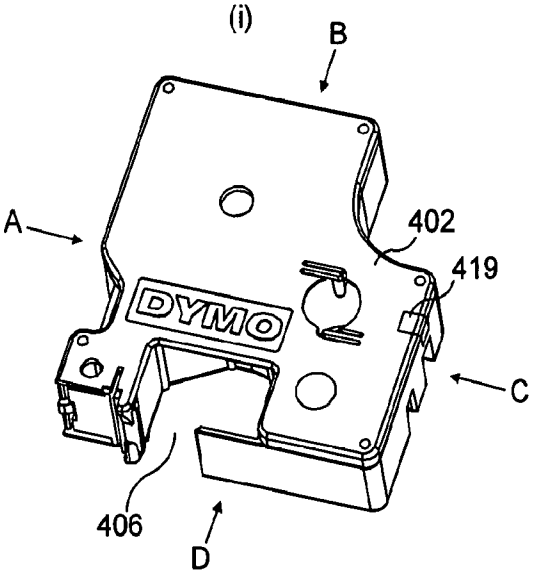
FIG. 20*a* is a top perspective view of a 12 mm cassette for use with the cassette detection means of FIG. 17.
Figure 20B:
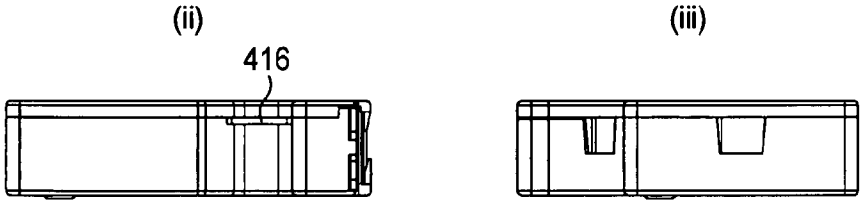
FIG. 20*b* is a right side view, taken in the direction designated by the arrow A of FIG. 20*a*, of the 12 mm cassette illustrated in FIG. 20*a;*
Figure 20C:
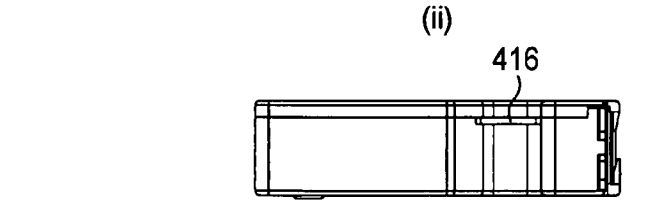
FIG. 20*c* is a rear view, taken in the direction designated by the arrow B of FIG. 20*a*, of the 12 mm cassette illustrated in FIG. 20*a;*
Figure 20D:
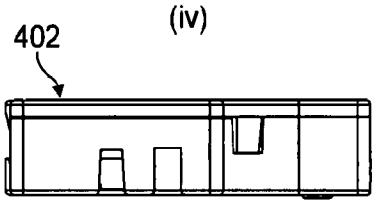
FIG. 20*d* is a left side view, taken in the direction designated by the arrow C of FIG. 20*a*, of the 12 mm cassette illustrated in FIG. 20*a;*

Referring to FIG. 17, the first locking element 26 comprises cassette detection. The cassette detection comprises first and second contact pads 302, 304, which are connected to cassette detection circuitry 310 by means of respective first and second conduction connections such as wires, conductive pads, conductive material, etc. 306, 308. These conduction connections will be referred to as wires in the following but as will be appreciated this is by way of example only and the wires can be replaced by any other suitable conduction arrangement. The first and second contact pads 302, 304 are disposed on the lower surface (that is the surface which engages the cassette) of the projection 34 of the first locking element 26. The first wire 306 is connected to the first contact pad 302 at one end and extends from the first contact pad 302 along the surface of the elongate element 36 and is connected at the other end to the cassette detection circuitry 310. Similarly, the second wire 308 connects the second contact pad 304 to the cassette detection circuitry 310. In the current embodiment of the present invention, the second locking element 32 is similarly provided with first and second contact pads 302, 304 which are connected to the cassette detection circuitry 310 via first and second wires 306, 308, respectively.

Referring to FIG. 18, the cassette 400 comprises a housing having a top 402, a base 404, and side surfaces A, B, C and D. The cassette houses an ink ribbon and a print receiving tape, or alternatively the cassette houses only a print receiving tape. In both embodiments the print receiving tape may be continuous image receiving medium or the print receiving tape may be die cut labels on a continuous backing layer. An opening 406 is provided in the cassette housing through which the printhead of the label printer passes when the cassette is inserted into the cassette-receiving bay of the label printer. The tape and ink ribbon 408, 410 pass the opening 406 whereby the ink ribbon and tape 408, 410 are nipped between the platen and the printhead of the printer in use. An ink ribbon take-up spool 412 is provided which cooperates with a sprocket in the printer for driving the ink ribbon during printing.

As shown in FIG. 18(*i*) and (ii), side A of the cassette comprises a recess 414 extending from the base 404 to the top 402 of the cassette to form a guide. A locking member 416 is provided in the recess 414 in the form of a rib extending across the recess in a direction parallel to the base and the top of the cassette. Providing the locking member 416 in a recess 414 saves space and allows for a smaller printer and/or a larger cassette. As shown in FIG. 18(*iii*), side C of the cassette comprises another locking member 418 in the form of an opening in the side wall for cooperating with a locking element of the printer.

The recess 414 and locking member 416 of the label cassette may be arranged to form a combined guiding and locking arrangement which cooperates with a complementary guiding and locking arrangement in the cassette-receiving bay of the printer.

The upper surface of locking member 416 is provided with a electrically conductive contact pad 417. Similarly, the base of the opening which forms the locking member 418 is also provided with an electrically conductive contact pad 429.

FIGS. 19 and 20 show similar structural features of a 19 mm cassette and a 12 mm cassette respectively. The cassettes form a set comprising label cassettes of differing widths as measured from the base to the top. It can be seen by comparing FIGS. 18 to 20 that the ratio of a distance between the base and the locking members and a distance between the locking members and the top increases on decreasing width. That is, the smaller the width of the cassette then the higher the locking members are located on the cassette. In fact, the 12 mm cassette does not have an locking opening in side C at all and in this case the top of the label cassette 102 interacts with the locking element 26 in the printer. In the case of the 12 mm cassette, an electrically conductive contact pad 419 is provided on the top of the cassette 102, such that the contact pad 419 is in contact with the second locking element 32 of the label printer 2, when the cassette is inserted into the cassette-receiving bay 8. This aforementioned arrangement allows for label cassettes of differing widths to be positioned and locked in the correct printing position in a label printer.

The operation of the above described locking mechanism, ejector mechanisms and cassette detection means will now be described. When there is no cassette inserted in the cassette-receiving bay 8, the spring 50 of each ejector mechanism 41 is in an unextended state and, accordingly, each ejector element 24, 28, 30 is disposed at the top end of the corresponding slot in the side wall 12 of the cassette-receiving bay 8. The locking elements 26, 32 of the locking mechanism are biased towards the locking position, by means of the return spring 74 acting on the actuating bar 64.

When a cassette is inserted into the cassette receiving bay 8, the base of the cassette presses down on each ejector element 24, 28, 30. This, in turn, causes the body portion 40 of each ejector to move downwards along the shaft 52 and causes the spring 50 to extend. As the body portion 40 moves downwards, the rack portion 44 is meshed with the pinion 56 of the damper 54. Accordingly, the pinion 56 of the damper 54 is rotated as the cassette is inserted and provides a resistance to the force applied to the cassette by a user who inserts the cassette into the cassette receiving bay 8. The resistance provided by the pinion 56 engaging with the rack portion 44 is preferably selected so as not to be so great that a user requires excessive force to insert a cassette into the cassette-receiving bay 8, which could damage components of the ejector mechanisms.

When the cassette has been inserted fully into the cassette-receiving bay, the locking elements 26, 32 engage with corresponding portions of the cassette, so as to hold the cassette in the cassette-receiving bay 8 against the force exerted on the base of the cassette by the ejector elements 24, 28, 30. More specifically, the projection 34 of the first locking element 26 engages with locking member 418 of the cassette. Accordingly, the first and second contact pads 302, 304 of the first locking element 26 are in contact with the conductive pad 429 of the locking member 418. The conductive pad 429 of the locking member 418 is dimensioned such that a conductive connection between the first and the second pad is created when the locking element engages the locking member. Similarly, the projection 34 of the second locking element 32 engages with locking member 416 of the cassette. Accordingly, the first and second contact pads 302, 304 of the second locking element 32 are in contact with the conductive pad 417 of the locking member 416. The conductive pad 417 of the locking member 416 is dimensioned such a conductive connection is created between the first and the second pad when the locking element engages the locking member.

The cassette detection circuitry 310 may detect the engagement of the first and second locking elements 26, 32 with the locking members 418, 416 of the cassette, by measuring the resistance, voltage or current, or by substituting the measured value into an analog or digital measurement between the first and second contact pads 302, 304 of each locking element 26, 32. For example, if a voltage is applied to the first contact pad then a current will flow between the first and second contact pads 302, 304, via the respective conductive pads of the cassette locking members 418, 416. Accordingly, the cassette detection circuitry can determine whether the first and second locking elements 26, 32 are properly engaged with the cassette by detecting the flow of the current.

Figure 21A:
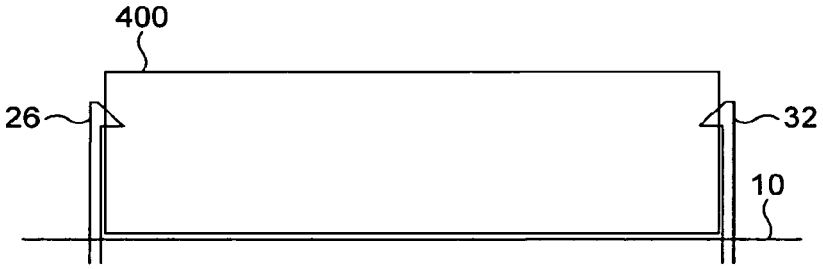
FIG. 21*a* shows a schematic representation of a cassette inserted in a cassette receiving bay where the first and second locking elements are properly engaged with the cassette.
Figure 21B:
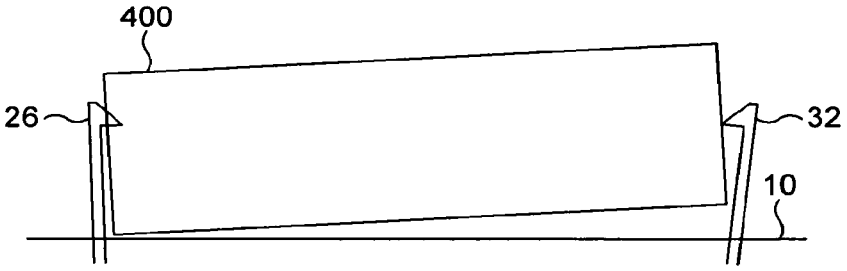
FIG. 21*b* shows a schematic representation of a cassette inserted in a cassette receiving bay where the first locking element is properly engaged with the cassette and the second is not engaged with the cassette.

Referring to FIG. 21 (*i*), when the cassette is correctly inserted and both the first and second locking elements 26, 32 are properly engaged, the cassette detection circuitry determines that the cassette is correctly inserted and printing may be commenced. Referring to FIG. 21 (*ii*), it is possible that one of the locking elements will not be properly engaged with the cassette if, for example, the cassette is inserted with an uneven force. In this case, no current will flow between the first and second contact pads 302, 304 of the second locking element 32 because the first and second contact pads 303, 304 are not in contact with the conductive pad of the cassette locking member 416. The cassette detection circuitry will determine that the second locking element 32 is not engaged properly with the cassette.

When it is determined by the cassette detection circuitry that one or more of the locking elements 26, 32 is not properly engaged with the cassette, a label printer controller (not shown) may control the label printer to prevent printing. Furthermore, the controller may inform a user via a display means (not shown), which may be a liquid crystal display, that the cassette is not properly inserted. In the present embodiment, the cassette detection circuitry is operable to determine which of the one or more locking element 26, 32 is not properly engaged with the cassette. Accordingly, the controller may inform the user via the display means, as to which locking element/s are not engaged with the cassette and may further inform the user as to what action is required in order to correctly insert the cassette. For example, the control may display a diagram similar to FIG. 21 (*ii*) on the display means, to indicate which side of the cassette must be pressed in order for the cassette to be inserted properly. Such an indication may also be displayed in the event that one or more of the locking elements disengages from the cassette, for example, as a result of the printer being dropped and subjected to a sudden impact. The latter may also be displayed in the event that one or more of the locking elements disengages from the cassette during transport of the label printer with a cassette installed.

Once the cassette has been inserted correctly, the cassette detection circuitry detects the engagement of the locking elements 26, 32 with the cassette and the controller enables printing to commence.

After printing, a cassette may be ejected by a user pressing the eject button 29. When the eject button 29 is pressed, the downward movement of the actuating part 82 causes the angled flange part 85 to push against the first end 65 of the actuating bar 64. Referring again to FIG. 15, the actuating bar 82 rotates around its centre of rotation 76 in an anti-clockwise direction (as viewed). Accordingly, the coupling member 66 of the first locking element 26 rotates clockwise around centre of rotation 70, thereby moving the first locking element 26 to the unlock position. At the same time, the coupling member 68 of the second locking element 32 rotates anti-clockwise around centre of rotation 72, thereby moving the second locking element 32 to the unlock position.

With the locking elements 26, 32 in the unlock position, the cassette is free to move under the force exerted by the ejector elements 24, 28, 30. As the expansion springs 50 of the ejector mechanisms 41 contract, the ejector elements 24, 28, 30 move up their corresponding slits in the side walls 12 of the cassette-receiving bay 8 and push the cassette out of the cassette receiving bay 8. At the same time, the rack portion 44 of each ejection mechanism 41 is meshed with the pinion 56 of the corresponding damper 54. Accordingly, the engagement of the rack portion 44 and the pinion 56 provides a resistance to the upward movement of the ejector elements 24, 28, 30. Thus, by employing a damper 54, the acceleration of an ejector element in the upward direction under the force of the expansion spring 50 is reduced. The cassette is thus gradually ejected from the cassette-receiving bay 8. The degree of resistance provided by the pinion 56 of the damper 54 may be determined by the viscosity of oil used to lubricate the pinion with respect to the damper mount part 58.

In an alternative embodiment of the present invention, only one of the locking elements may be provided with contact pads for detecting engagement of that particular locking element with the cassette. In this case the user may be informed of whether or not the locking element provided with the contact pads is properly engaged with the cassette. Preferably, the one locking element provided with contact pads is positioned adjacent the print head such that it is detected that the cassette is positioned correctly adjacent the position where the image is formed on the tape. In another embodiment, the label printer is only provided with a single locking element for retaining a cassette in the cassette receiving bay. In this case, the single locking element could be provided with contact pads for detecting the insertion of a cassette as described above. Preferably, the single locking element is positioned adjacent the print head.

Figure 22:
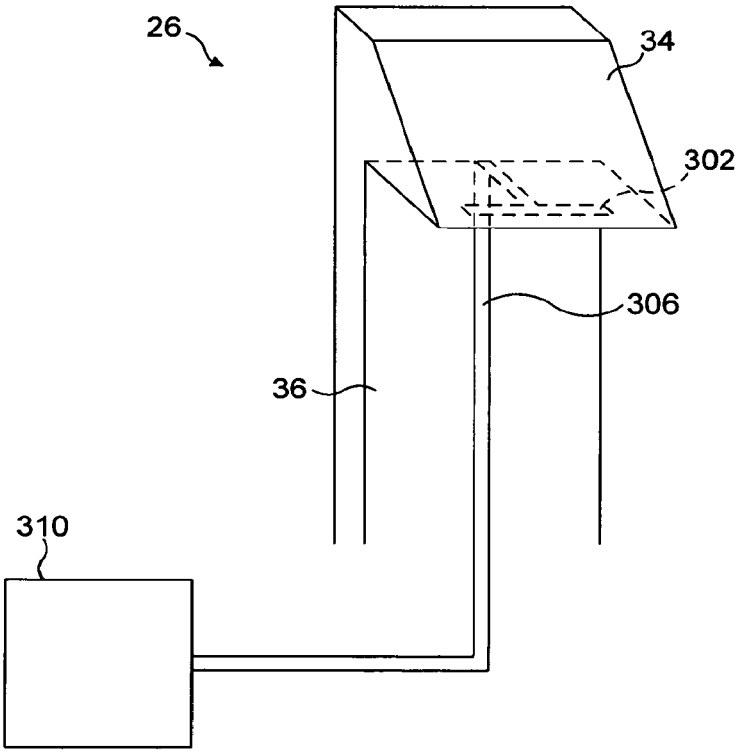
FIG. 22 is an enlarged view of the first locking element shown in FIG. 4, showing cassette detection means according to an alternative embodiment of the present invention.
Figure 23A:
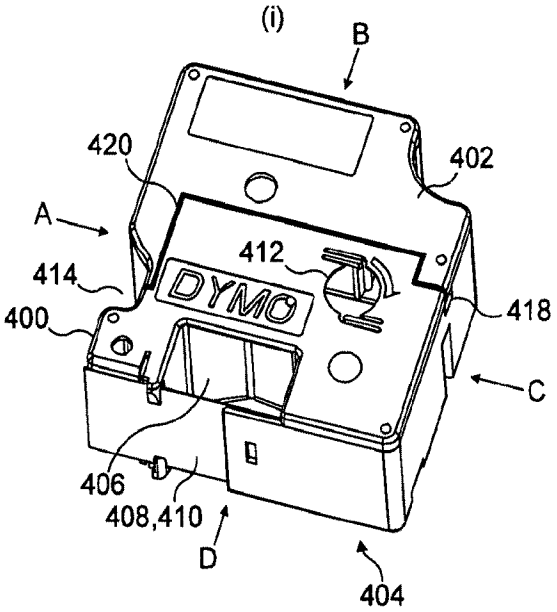
FIG. 23*a* is a top perspective view of a 24 mm cassette for use with the cassette detection means of FIG. 22.
Figure 23C:
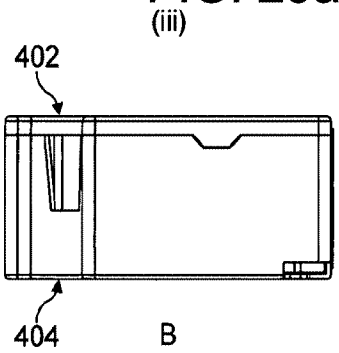
FIG. 23*c* is a rear view, taken in the direction designated by the arrow B of FIG. 23*a*, of the 24 mm cassette illustrated in FIG. 23*a;*
Figure 23D:
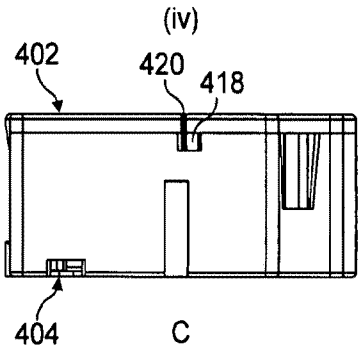
FIG. 23*d* is a left side view, taken in the direction designated by the arrow C of FIG. 23*a*, of the 24 mm cassette illustrated in FIG. 23*a;*
Figure 23B:
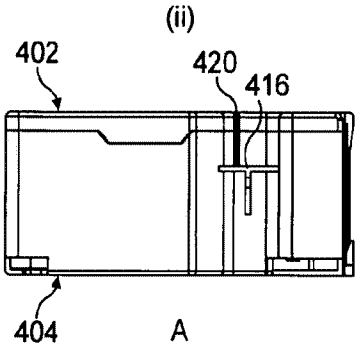
FIG. 23*b* is a right side view, taken in the direction designated by the arrow A of FIG. 23*a*, of the 24 mm cassette illustrated in FIG. 23*a;*

Referring to FIG. 22, in yet another embodiment of the present invention, the first locking element 26 is provided with a single contact pad 302 which is connected to cassette detection circuitry 310 by conductive connection 306, which can of course take any suitable format such as a wire or the like. Similarly, the second locking element 32 is provided with a single contact pad which is connected to the cassette detection circuitry 310 by means of a conductive connection such as a wire 306 or the like. This arrangement can be used to detect the correct insertion of cassette of the type shown in FIGS. 23 to 25.

Referring to FIG. 23, the cassette 400 is the identical to that described above with reference to FIG. 18, with the exception that the conductive pads 302 of the cassette locking members 416, 418 connected by a continuous conductive connection 420 disposed on the upper surface 402 of the cassette. This connection can of course take any suitable format and in one embodiment is in the form of a metal track. The position of the connection is one example and may be provided on any other side or sides of the cassette. The position of the connection on the surface is also by way of example and may be provided at any suitable position. The continuous conductive connection could take any format and could be a form of conductive strip, tape or paint on surface of the cassette, or a thicker conductive member which follows a path between the conductive contact pads 302. The continuous conductive connection may be arranged in the interior of the cassette, such as along a surface inside the cassette or as a component in the cassette. Accordingly, when the cassette is correctly inserted the cassette-receiving bay 8, the contact pad of the first locking element 26 is in contact with the conductive pad of the locking member 418 and the contact pad of the second locking element 32 is in contact with the conductive pad of the locking member 416. The cassette detection circuitry 310 can therefore detect that the cassette has been properly engaged by both the first and second locking elements 26, 32 by, for example, by measuring the resistance, voltage or current, or by substituting the measured values with an analog or digital measurement flowing between the contact pads of the first and second locking elements 26, 32, via the conductive connection 420.

FIGS. 24 and 25 show cassettes which correspond to those shown in FIGS. 19 and 20, but with the addition of a conductive connection 420 running across the top of the cassette to between the conductive pads. The conductive pads may be formed integrally with the conductive connection.

A further embodiment of the present invention will now be described with reference to FIGS. 27 to 35. For conciseness, any like part of the label printer 2' in these figures will be referred to with the same reference numeral as that used in FIGS. 1 and 7 but with an apostrophe (') suffix.

Figure 27:
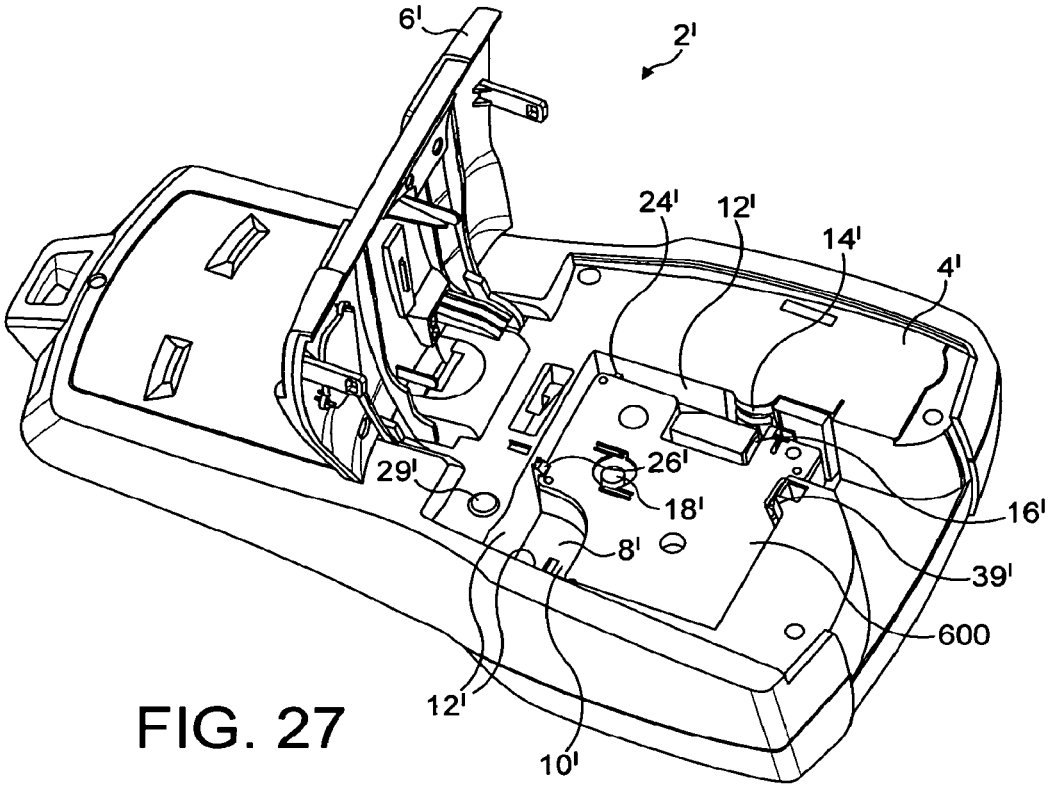
FIG. 27 is a top perspective view of another embodiment of a label printer according to the present invention, the label printer having its lid open and a cassette present.
Figure 28:
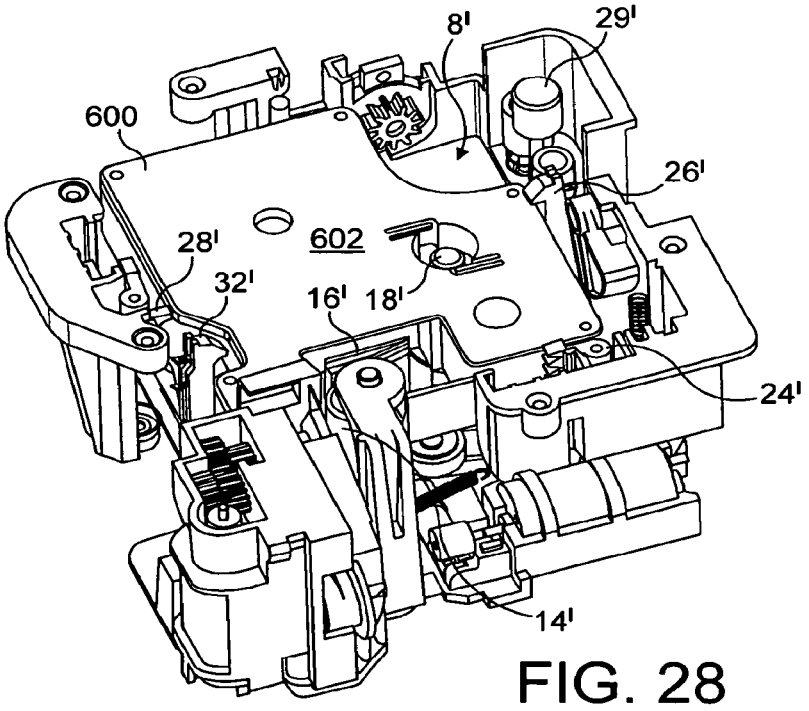
FIG. 28 is a perspective view of the label printer of FIG. 27 illustrating the positions of first and second locking elements and first and second ejector elements with a cassette installed in the cassette-receiving bay.

Referring to FIGS. 27 and 28, the label printer 2' of the further embodiment comprises a body 4', a cover 6', and a cassette-receiving bay 8' substantially as described above. A platen 14' and a printhead 16' are again provided in the cassette-receiving bay 8'. An ink ribbon take-up sprocket 18' again extends from the base 10' into the cassette-receiving bay 8'.

First and second ejector elements 24', 28' similar to those described above are visible on side-walls of the cassette-receiving bay 8'. An actuator button 29' is again provided on the surface of the body 4' for actuating the locking mechanism. To eject a cassette 600 from the printer 2', the ejector button 29' is actuated by a user pressing down on it, which unlocks the locking mechanism as discussed above. The ejectors 24', 28' push the cassette 600 upwards for easy removal from the printer 2'. The operation of the ejectors and actuator button 29' is the same as that described above so, for conciseness, the operation of these will not be further described herein.

Also visible is a first locking element 26' of a locking mechanism (which is not visible but is the same in operation as that described above). A second locking element 32' of the locking mechanism is positioned on the side wall of the cassette-receiving bay 8' opposite from the first locking element 26'.

As for the previously-described embodiment, each of the locking elements 26', 32' is provided at a side of the cassette-receiving bay 8' and extends part way into the cassette-receiving bay 8' through an opening in the side wall 12' of the receiving bay 8' for interaction with an inserted cassette 600. Each locking element 26', 32' comprises a body 37' comprising a projection 34' and an elongate element 36' that extends in a direction from the base 10' to the top opening of the cassette-receiving bay 8'. The projection 34' is at a top end of the elongate element 36' and extends towards a central portion of the cassette-receiving bay 8' substantially perpendicularly to the elongate axis of the elongate element 36'. One of the side walls of the cassette-receiving bay 8' has a guide portion 39' and one of the locking elements 32' is positioned in an opening in the guide portion 39'.

Referring to FIGS. 27 to 33 and 35, when a cassette 600 is installed in the cassette-receiving bay 8', the first and second locking elements 26', 32' are in the locking position. During insertion, the cassette 600 contacts the locking elements 26', 32'. The projections 34' of the locking elements 26', 32' have sloped upper surfaces for cooperating with the cassette 600 such that, as the cassette 600 is inserted into the bay 8', the locking elements 26', 32' are moved backwards by the cassette 600 from the locking position to an unlocked position in corresponding openings in the side walls 12'. The locking elements 26', 32' are biased to move into the locking position when the cassette 600 is correctly loaded to prevent the cassette 600 from moving in an upward direction by interacting with locking members 616, 618 of the cassette 600, which are discussed below.

Figure 33:
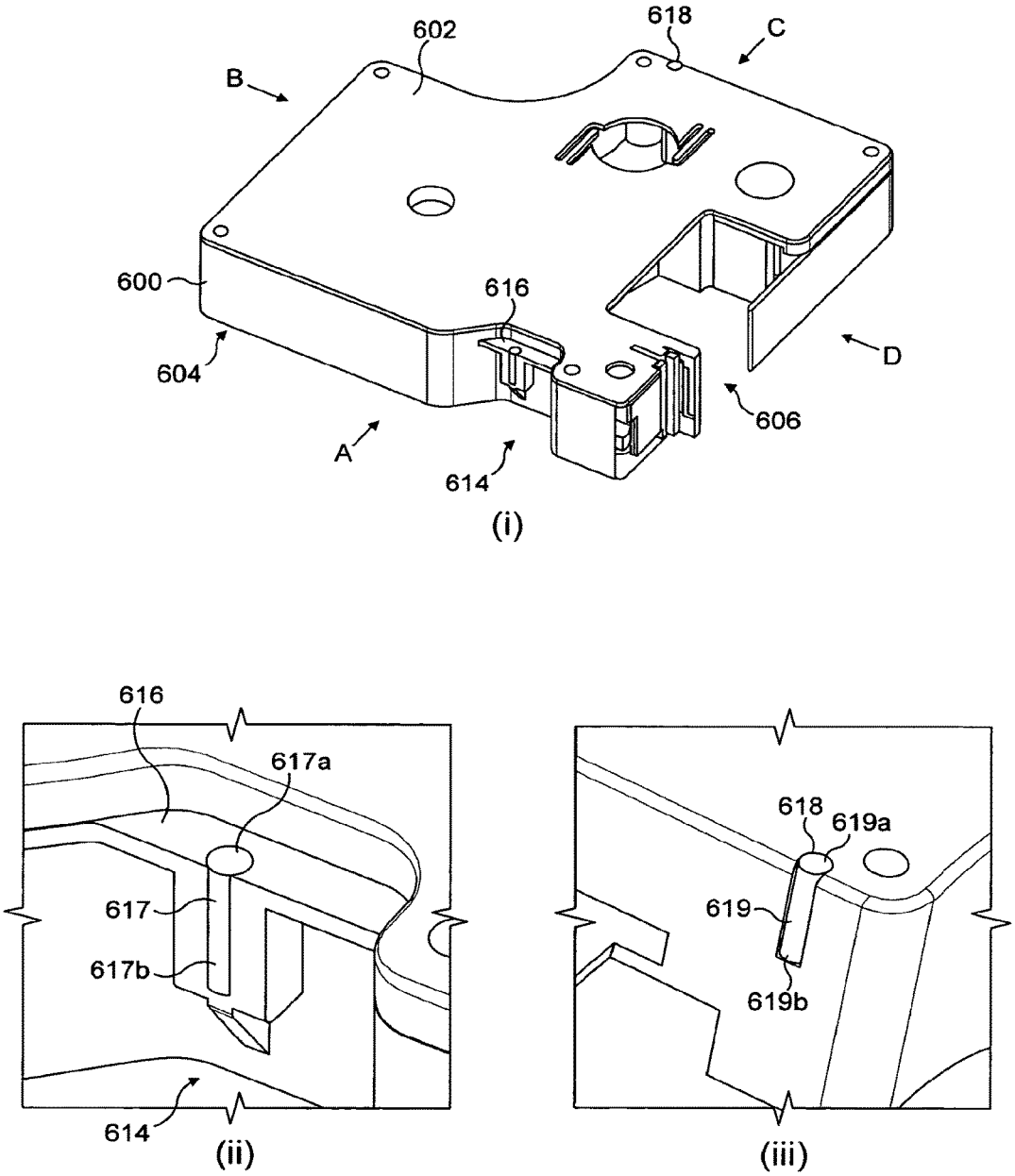
FIG. 33 shows three views of a cassette for use with the label printer of FIG. 27: (i) a top perspective view; (ii) close up of Side A; (iii) close up of side C.

Referring to FIG. 33, a cassette 600 comprises a housing having a top 602, a base 604, and side surfaces A, B, C and D. In this embodiment the cassette 600 houses an ink ribbon and a print receiving tape as described above. In alternative embodiments the cassette 600 houses only a print receiving tape. The various forms of print receiving tape discussed above are equally applicable to this embodiment.

As shown in FIG. 33(*i*), and in close-up in FIG. 33(*ii*), side A of the cassette 600 comprises a recess 614 extending from the base 604 to the top 602 of the cassette 600 to form a guide. A locking member 616 is provided in the recess 614 in the form of a rib extending across the recess in a direction parallel to the base 604 and the top 602 of the cassette. This locking member 616 is for cooperating with the second locking element 32' of the printer 2'. As shown in FIG. 33(*i*), and in close-up in FIG. 33(*iii*), side C of the cassette comprises another locking member 618 in the form of a portion of the top 602 of the cassette 600 for cooperating with the first locking element 26' of the printer 2'.

The recess 614 and locking member 616 of the label cassette are arranged to form a combined guiding and locking arrangement which cooperates with a complementary guiding and locking arrangement in the cassette-receiving bay 8' of the printer 2'.

The upper surface of locking member 616 is provided with a first contact surface 617*a* of an electrically-conductive contact pad 617. The contact pad 617 comprises a conductive area of a cylindrical bar and the first contact surface 617*a* is comprised in the top end surface of the bar. The bar is recessed into the cassette housing and extends along a side A of the cassette 600 in a direction perpendicular to the top 602 of the cassette 600. Side A of the cassette also includes a second contact surface 617*b* of the electrically-conductive contact pad 617. The second contact surface 617*b* comprises an elongate side surface of the bar and runs substantially perpendicularly to the first contact surface 617*a*.

Similarly, the portion of the top 602 of the cassette 600 which forms the locking member 618 is provided with a first contact surface 619*a* of an electrically-conductive contact pad 619. The contact pad 619 also comprises a conductive area of a cylindrical bar and the first contact surface 619*a* is comprised in the top end surface of the bar. The bar is recessed into the cassette housing and extends along side C of the cassette 600 in a direction perpendicular to the top 602 of the cassette 600. Side C of the cassette also includes a second contact surface 619*b* of the electrically-conductive contact pad 619. The second contact surface 619*b* comprises an elongate surface of the bar and runs substantially perpendicularly to the first contact surface 619*a*.

Although in this embodiment the contact pads 617, 619 are shown to comprise the end and outer curved surfaces of bars that have circular cross-sections, in other embodiments the bars may be replaced with blocks of different cross-sections, such as square or rectangular cross-sections. Thus, the second contact surfaces 617*b*, 619*b* may then comprise flat outer surfaces of respective blocks.

In other embodiments, only the contact surfaces 617*a*, 619*a*, 617*b*, 619*b* of the bars may be exposed, while the conductive paths between the surfaces are encased in the cassette housing. In still further embodiments, the bars may be attached onto the sides A and C of the cassette 600, rather than being partly or fully recessed into the sides A, C.

In other embodiments, the contact pads 617, 619 may comprise thin layers (such as film, paint or tape) applied to or set into the surface of the cassette 600. The contact surfaces 617*a*, 619*a*, 617*b*, 619*b* may then each comprise portions of the thin layers.

Referring to the cut-away view in FIG. 34, a first locking element 26' of this further embodiment will be described. The first locking element 26' comprises cassette detection. The cassette detection comprises first and second contact pads 702, 704, which comprise conductive portions of respective first and second conductive members 703, 705 that protrude from the body 37' of the first locking element 26'. The members 703, 705 comprise metal strips that pass through the first locking element 26' from the side of the elongate element 36' of the first locking element 26' from which the projection 34' projects to the side of the elongate element 36' opposite that from which the projection 34' projects. The first and second contact pads 702, 704 are located on the side of the elongate element 36' from which the projection 34' projects.

The first contact pad 702 lies adjacent the lower surface (that is the surface which engages the cassette) of the projection 34' of the first locking element 26', and in this embodiment comprises a bent portion of the end of the first conductive member 703. The second contact pad 704 lies adjacent a surface of the elongate element 36' that extends perpendicularly from the lower surface of the projection 34' of the first locking element 26'. In this embodiment the second contact pad 704 comprises a bent portion of the end of the second conductive member 705.

The first and second conductive members 703, 705 are connected to cassette detection circuitry 710 by means of respective first and second conduction connections such as wires, conductive pads, conductive material, etc. 706, 708. The first conduction connection 706 is connected at one of its two ends to a connection point 701 of the first conductive member 703, and is connected at its other end to the cassette detection circuitry 710. The second conduction connection 708 is similarly connected to a connection point 709 of the second conductive member 705, and is connected at its other end to the cassette detection circuitry 710. As above, the conduction connections could be wires or any other suitable conduction arrangement.

In the current embodiment of the present invention, the second locking element 32' is similarly provided with first and second contact pads 702, 704 which are connected to the cassette detection circuitry 710 via first and second conduction connections 706, 708, respectively.

Figure 34:
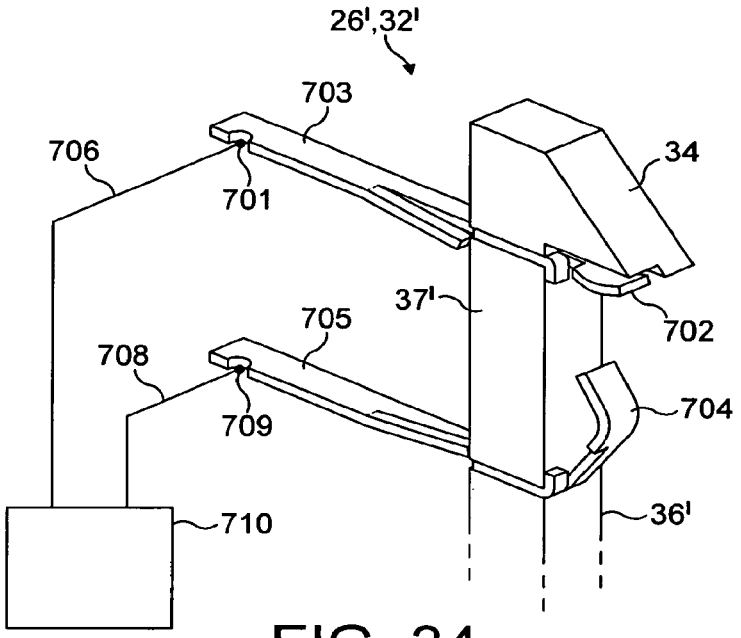
FIG. 34 shows a section view through one of the at least one locking elements of the label printer of FIG. 27 when no cassette is installed in the cassette-receiving bay.

FIGS. 29, 31, 32 and 25 illustrate in detail the cassette 600 of FIG. 33 locked in the cassette receiving bay 8' by the first and second locking elements 26, 32 of FIG. 34. As can be seen in these figures, when the cassette 600 is correctly inserted in the receiving bay 8', the locking elements 26', 32' engage with the corresponding locking members 618, 616 of the cassette 600.

More specifically, the projection 34' of the first locking element 26' engages with locking member 618 of the cassette 600. Accordingly, the first contact pad 702 of the first locking element 26' is in contact with the first contact surface 619*a* of the contact pad 619 of the locking member 618, and the second contact pad 704 of the first locking element 26' is in contact with the second contact surface 619*b* of the contact pad 619 of the locking member 618. The first and second contact surfaces 619*a*, 619*b* of the locking member 618 are each dimensioned such that a conductive connection between the first and the second contact pads 702, 704 of the first locking element 26' is created via the contact pad 619 when the first locking element 26' engages the locking member 618.

Similarly, the projection 34' of the second locking element 32' engages with locking member 616 of the cassette 600. Accordingly, the first contact pad 702 of the second locking element 32' is in contact with the first contact surface 617*a* of the contact pad 617 of the locking member 616, and the second contact pad 704 of the second locking element 32' is in contact with the second contact surface 617*b* of the contact pad 617 of the locking member 616. The first and second contact surfaces 617*a*, 617*b* of the locking member 616 are each dimensioned such that a conductive connection between the first and the second contact pads 702, 704 of the second locking element 32' is created via the contact pad 617 when the second locking element 32' engages the locking member 616.

The contact pads 702, 704 are each biased away from the body 37' of the locking element 26', 32' on which they are arranged. When a force applied to contact pad 702 in a direction substantially towards the lower surface of the projection 34' is removed, the contact pad 702 springs away from the lower surface of the projection 34' of the body 37' to a resting position. Similarly, when a force applied to contact pad 704 in a direction substantially towards the elongate element 36' (i.e. substantially perpendicular to said direction towards said lower surface) is removed, the contact pad 704 springs away from the elongate element 36' of the body 37' to its resting position.

To illustrate this, in FIG. 34 no such forces are applied to the contact pads 702, 704, so the contact pads 702, 704 are in their respective resting positions. In the cut-away view of FIG. 35, the contact pads 702, 704 of the printer 2' are shown in contact with one or other of the contact pads 617, 619 of the cassette 600 when the cassette 600 is correctly installed in the printer 2'. There is an interference fit between the contact pads 617, 619 and the contact pads 702, 704 when the cassette 600 is correctly installed in the printer 2', so the contact pads 702, 704 of the locking elements 26', 32' are moved away from their resting positions. As the contact pads 702, 704 of the locking elements 26', 32' are biased to their resting positions, good contact (and thus good electrical connection) is made between them and the contact pads 617, 619 of the cassette 600.

Figure 29:
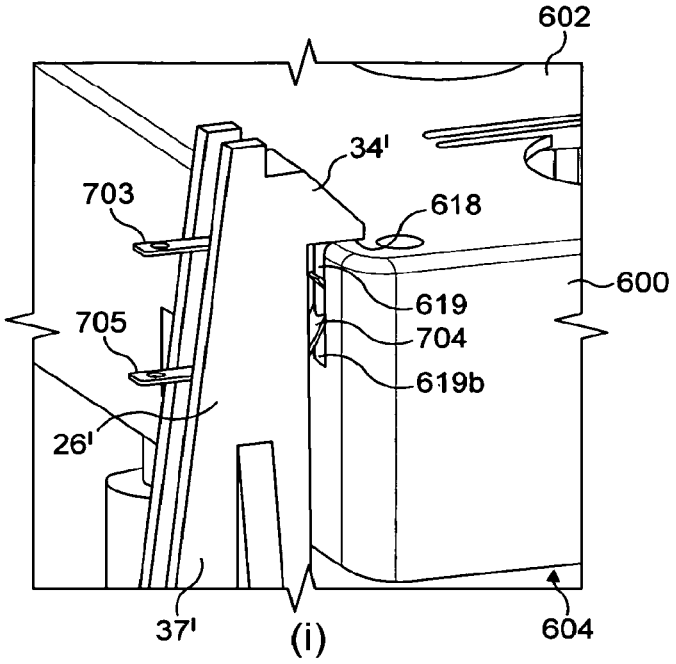
FIG. 29(*i*) is a view illustrating the interaction with a cassette of a first locking element of the label printer shown in FIG. 27, and FIG. 29(*ii*) is a view illustrating the interaction with a cassette of a second locking element of the label printer shown in FIG. 27.
Figure 29:
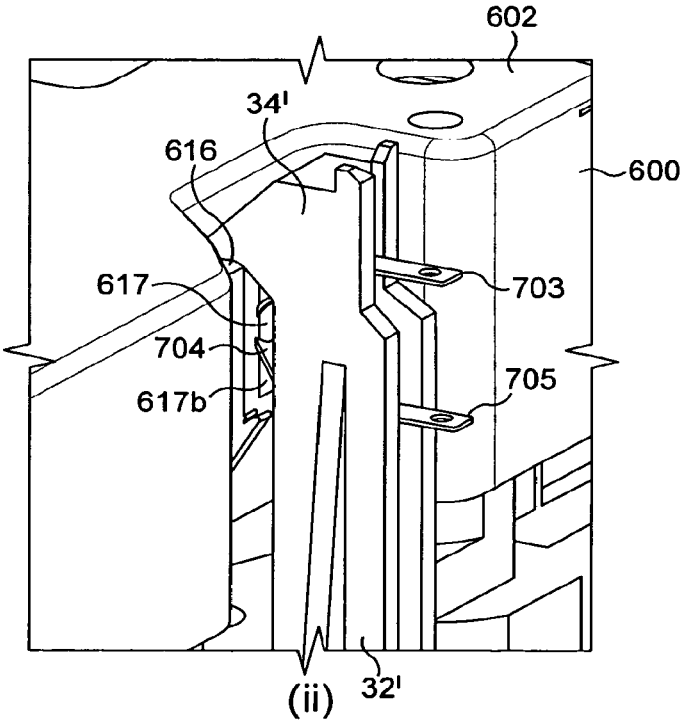
Figure 30:
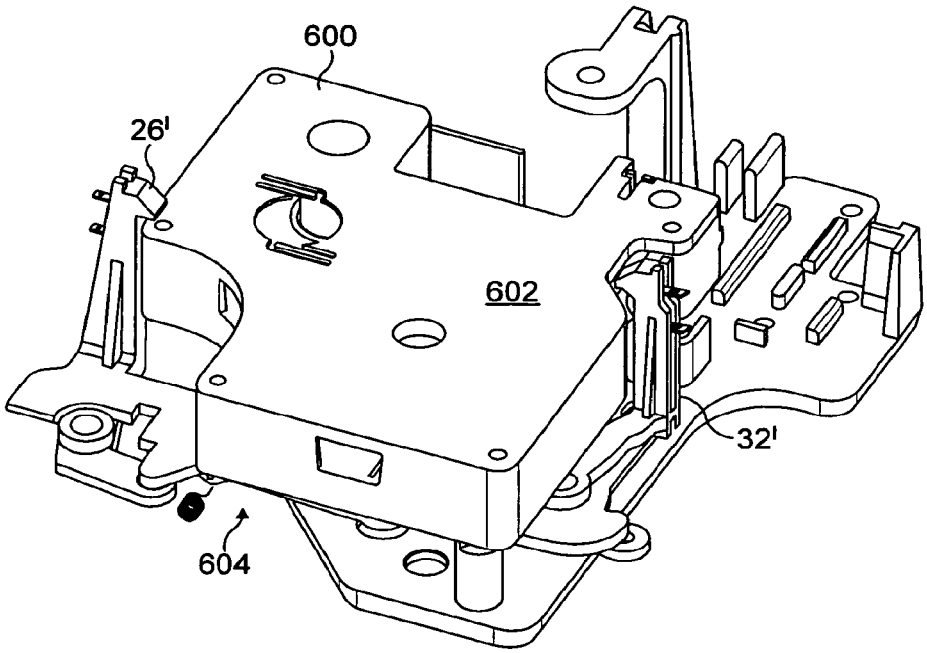
FIG. 30 is another perspective view of the label printer of FIG. 27 illustrating the positions of the first and second locking elements with a cassette installed in the cassette-receiving bay.
Figure 31:
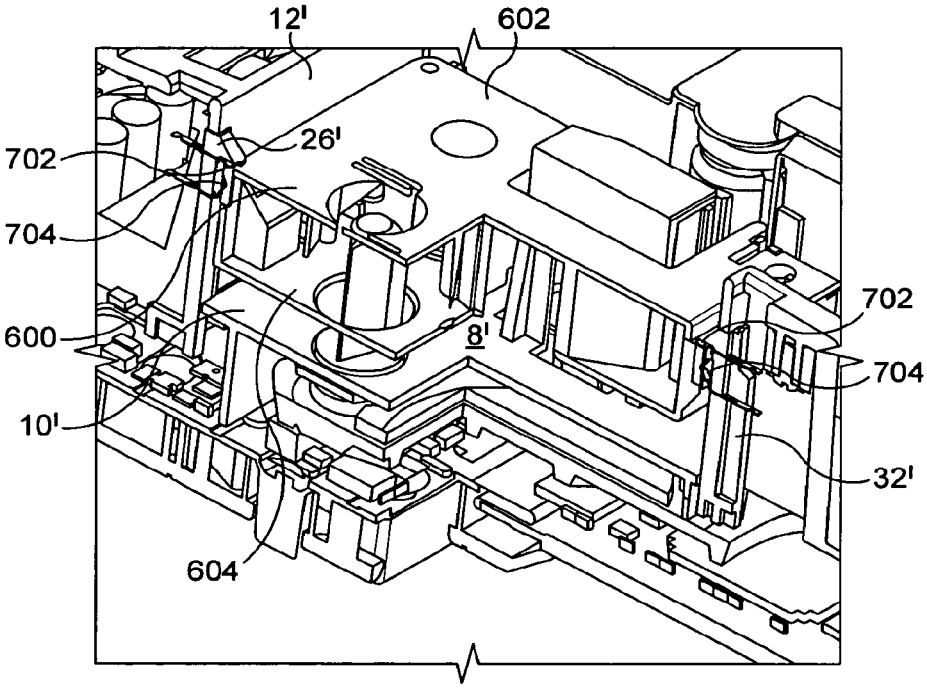
FIG. 31 is a section view through the label printer and cassette shown in FIG. 30.
Figure 32:
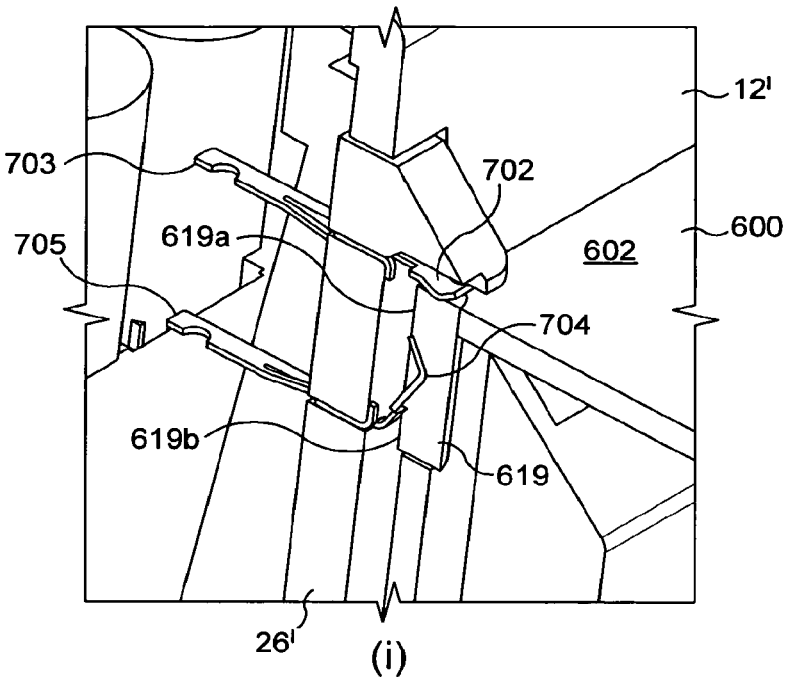
FIG. 32 is a close up view of the label printer and cassette shown in FIG. 31, with (i) showing the interaction with the cassette of the first locking element, and (ii) showing the interaction with the cassette of the second locking element.
Figure 32:
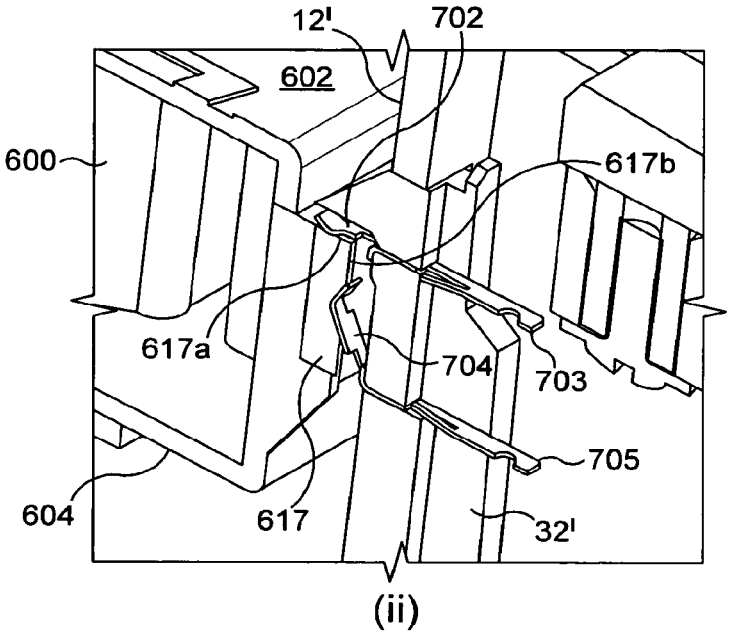
Figure 35:
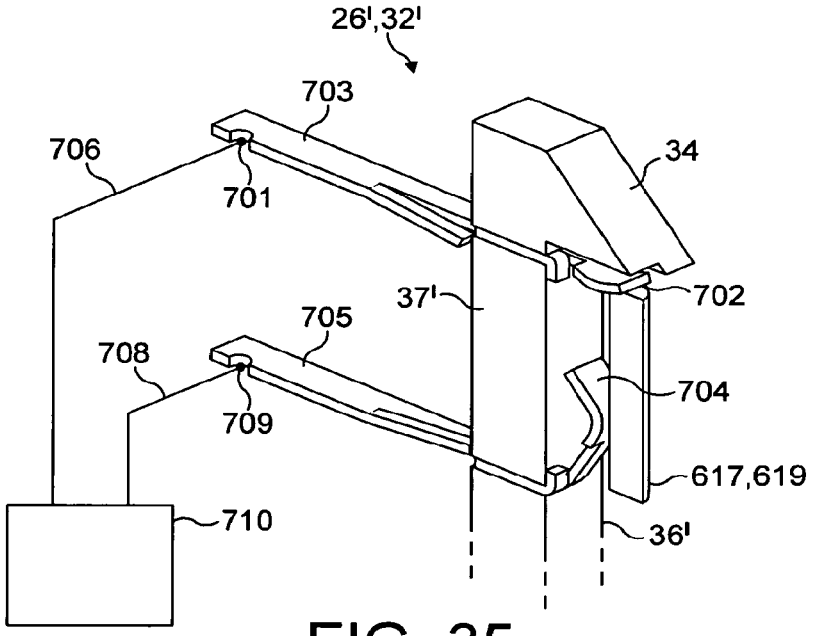
FIG. 35 shows a section view through the locking element of FIG. 34 when a cassette is correctly installed in the cassette-receiving bay.

Although in FIGS. 29, 31 and 32 the contact pads 704 of the locking elements 26', 32' are shown to cut into the second contact surfaces 617*b*, 619*b* of the contact pads 617, 619, the skilled person would understand that the contact pads 704 actually flex when brought into contact with the cassette 600. FIG. 35 provides a more accurate illustration of the actual interface between the locking elements 26', 32' and cassette 600.

In this embodiment, this biasing towards the respective resting positions of the contact pads 702, 704 is provided by the inherent resilience of the material from which the conductive members 703, 705 are formed. In other embodiments one or both of the contact pads 702, 704 may not be bent and one or both of the contact pads 702, 704 may at a portion between the ends of the conductive members 703, 705. In other embodiments, other means for biasing the contact pads 702, 704 away from the bodies 37' of the locking elements 26', 32' may instead be provided. For example, the contact pads 702, 704 may be the ends of respective pins, which pins are mounted on respective bases attached to the locking elements 26', 32'. The biasing may then be provided by springs, such as coil springs, between the contact pads 702, 704 and the bases. Other alternative methods for biasing contact pads 702, 704 away from the bodies 37' of the locking elements 26', 32' will be obvious to the skilled person.

The cassette detection circuitry 710 may work as described above for the cassette detection circuitry 310. For example, if a voltage is applied to the first contact pad 702 of one of the locking elements 26', 32', then a current will flow between the first and second contact pads 702, 704 of that locking element via one of the respective conductive contact pads 617, 619 of the cassette 600. Accordingly, the cassette detection circuitry 710 can determine whether the first and second locking elements 26', 32' are properly engaged with the cassette 600 by detecting the flow of current.

The discussion above relating to FIGS. 21(*i*) and 21(*ii*) is also applicable to this further embodiment of FIGS. 27 to 35, with contact pads 702, 704 taking the place of contact pads 302, 304, cassette 600 taking the place of cassette 400, and cassette detection circuitry 710 taking the place of cassette detection circuitry 310. Thus, the cassette detection circuitry 710 can detect whether the locking elements 26', 32' are engaged with the cassette 600 (and thus determine whether the cassette 600 is correctly inserted) and enable printing to commence, or whether one or both of the locking elements 26', 32' is not engaged properly with the cassette 600. In the latter case, printing may be prevented, and in some embodiments the controller may inform a user via a display means (which may be a liquid crystal display) that the cassette 600 is not properly inserted.

The cassette detection circuitry 710 may be operable to determine which of the locking elements 26', 32' is not properly engaged with the cassette 600. Accordingly, the controller may inform the user via the display means as to which locking element/s are not engaged with the cassette 600, and may further inform the user as to what action is required in order to correctly insert the cassette. For example, the control may display a diagram similar to FIG. 21(*ii*) on the display means, to indicate which side of the cassette 600 must be pressed in order for the cassette 600 to be inserted properly.

In a further alternative embodiment of the present invention, only one of the locking elements 26, 32 shown in FIGS. 27 to 33 may be provided with contact pads 702, 704 for detecting engagement of that particular locking element with the cassette 600. In this case the user may be informed of whether or not the locking element provided with the contact pads 702, 704 is properly engaged with the cassette 600. The one locking element provided with contact pads 702, 704 may be positioned adjacent the print head 16', such that it is detected whether the cassette 600 is positioned correctly adjacent the position where the image is formed on the tape.

In another further embodiment, the label printer 2 is provided with only a single locking element for retaining a cassette 600 in the cassette receiving bay 8. In this case, the single locking element could be provided with contact pads 702, 704 for detecting the insertion of a cassette 600 as described above with reference to FIGS. 27 to 35. The single locking element may be positioned adjacent the print head 16'.

In yet another further embodiment, the printer includes a first locking element 26' that is provided with only a single one of the two contact pads 702, 704, which is connected to cassette detection circuitry by means of a respective one of the first and second conduction connections 706, 708. Similarly, the printer includes a second locking element 32' that is provided with only a single one of the two contact pads 702, 704, which is similarly connected to the cassette detection circuitry by means of another respective one of the first and second conduction connections 706, 708.

A cassette for use in such a printer could take the same general format as that best illustrated in FIG. 33, with the exception that the contact pad 617 is connected to contact pad 619 by a continuous conductive connection following a path between the pads 617, 619. Such a continuous conductive connection could take any format and could be a form of conductive strip, tape or paint on a surface of the cassette, or a thicker conductive member which follows a path between the conductive contact pads 617, 619. The continuous conductive connection may be arranged in the interior of the cassette, such as along a surface inside the cassette or as a component in the cassette. The continuous conductive connection could be similar to the metal track 420 discussed above. The continuous conductive connection may be integrally formed with one or both of the contact pads 617, 619, or be a separately-manufactured component. When the cassette is correctly inserted in the cassette-receiving bay, the contact pad of the first locking element 26' would be in contact with the contact pad 619, and the contact pad of the second locking element 32' would be in contact with the contact pad 617. The cassette detection circuitry can therefore detect that the cassette has been properly engaged by both the first and second locking elements 26', 32' by, for example, by measuring the resistance, voltage or current, or by substituting the measured values with an analogue or digital measurement, flowing between the contact pads of the first and second locking elements 26', 32', via the continuous conductive connection of the cassette.

In alternative embodiments of the present invention, the cassette detection means 310, 710 may be operable to determine characteristics relating to a cassette inserted into the cassette receiving bay in addition to whether the locking elements are properly engaged with the cassette. For example, by providing each different type of cassette with conductive contact pads having different electrical resistances, it would be possible for the controller to distinguish between the cassettes in dependence on the magnitude of the current/resistance detected by the cassette detection circuitry. In the case of cassettes provided with the conductive connection in the form of a metal track 420, this could be achieved by providing different types of cassette with different widths of metal track 420, in order to change the resistance.

It will be appreciated by those skilled in the art that the teachings of the present invention may equally be applied to a printer having a fixed print head and a movable platen. It will also be appreciated by the person skilled in the art, that the teachings of the present invention may be applied equally to a label printer in which the image receiving medium is a continuous tape and to one in which the image receiving medium is a plurality of die-cut labels arranged on a continuous backing layer.

Figure 26:
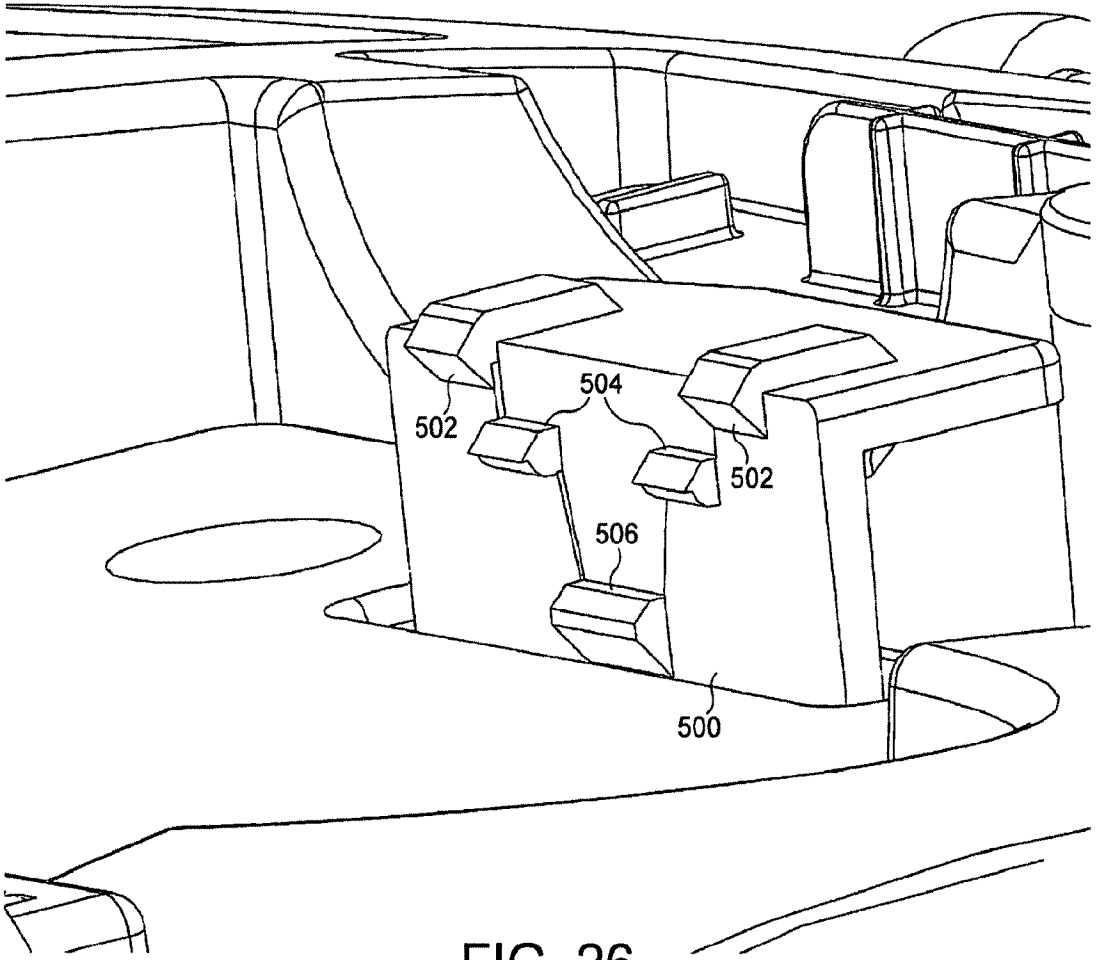
FIG. 26 shows an arrangement where a locking arrangement is provided on a printhead support.

In yet one alternative embodiment, at least one locking element is provided on the print head support part 500 as shown in FIG. 26. A first pair of locking elements 502 is arranged at a first height with a second pair of locking elements 504 is arranged at a second height and a third locking element 506 at a third height. The first height is greater than the second height which is greater than the third height. One or more of these locking elements may be provided. Each of the locking elements 502, 504 and 506 are positioned such that cassettes of different width are locked in the correct position.

In yet another alternative embodiment, the locking element is arranged to engage a rib or similar projection on the cassette. This may be provided on a side wall of the cassette or any other suitable surface. A similar electrical contact arrangement can be used with such an embodiment.

While this invention has been particularly shown and described with reference to preferred embodiments, it will be understood to those skilled in the art that various changes in form and detail may be made without departing from the scope of the invention as defined by the appended claims.

What is claimed is:

1. A cassette comprising at least one locking portion for engaging with a cooperating locking element of a label printer when said cassette is correctly inserted in said printer, said locking portion comprising a conductive area, said conductive area comprising a layer applied to or set in to a surface of the cassette, and said conductive area comprising a first region and a second region, a plane of said first region being substantially perpendicular to a plane of said second region.

2. A cassette as set forth in claim 1, wherein said layer comprises a pad.

3. A cassette as set forth in claim 1, wherein said layer comprises a film.

4. A cassette as set forth in claim 1, wherein said layer comprises a tape.

5. A cassette as set forth in claim 1, wherein said layer comprises a paint.

6. A cassette as set forth in claim 1, wherein said conductive area comprises a contact surface for contacting the cooperating locking element of the label printer, said contact surface comprising a portion of the layer.

7. A cassette as set forth in claim 1, configured such that when said cassette is correctly inserted in said printer said first region of said conductive area is positioned above said second region of said conductive area.

8. A cassette as set forth in claim 1, wherein said plane of said first region is substantially co-planar with a top surface of said cassette, and said plane of said second region is substantially co-planar with a side surface of said cassette.

9. A cassette as set forth in claim 1, wherein said cassette comprises a ledge portion, and wherein said plane of said first region is substantially co-planar with a top surface of said ledge portion, and said plane of said second region is substantially co-planar with a side surface of said ledge portion.

10. A cassette as set forth in claim 9, wherein said ledge portion is comprised in a recess in said cassette.

11. A cassette as set forth in claim 1, wherein said conductive area comprises a curved portion.

12. A cassette as set forth in claim 1, comprising two locking portions, each locking portion comprising a conductive area.

13. A cassette as claimed in claim 12, further comprising a conductive connection, wherein said conductive connection extends between said conductive areas to make a conductive path from one conductive area to another.

14. A cassette as claimed in claim 1, wherein said conductive area is arranged to give an indication of at least one parameter of said cassette.

15. A cassette as claimed in claim 1, wherein said cassette comprises a base surface, a top surface, and at least one side surface extending between said base surface and said top surface.

16. A cassette as claimed in claim 1, wherein said cassette comprises an outlet for a supply of label material, said supply of label material being substantially enclosed by said cassette.

17. A cassette as claimed in claim 1, comprising a supply of label material.

18. A cassette as claimed in claim 1, wherein said layer comprises a thin layer.

19. In combination, a label printing apparatus and a cassette as set forth in claim 1.

* * * * *